US011231675B2

(12) United States Patent
Kudo

(10) Patent No.: US 11,231,675 B2
(45) Date of Patent: Jan. 25, 2022

(54) IMAGE FORMING APPARATUS INCLUDING A ROTARY MEMBER AND A DETECTING MEMBER WHICH DETECTS LIGHT FROM THE SURFACE OF THE ROTARY MEMBER

(71) Applicant: CANON KABUSHIKI KAISHA, Tokyo (JP)

(72) Inventor: Yoshiki Kudo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/063,512

(22) Filed: Oct. 5, 2020

(65) Prior Publication Data

US 2021/0103240 A1 Apr. 8, 2021

(30) Foreign Application Priority Data

Oct. 8, 2019 (JP) ..... JP2019-185564

(51) Int. Cl.
*G03G 15/00* (2006.01)
*G03G 15/16* (2006.01)

(52) U.S. Cl.
CPC ..... *G03G 15/5058* (2013.01); *G03G 15/1615* (2013.01); *G03G 2215/1623* (2013.01)

(58) Field of Classification Search
CPC ..... G03G 15/1615; G03G 15/152; G03G 15/5054; G03G 15/5058; G03G 2215/1623; G03G 15/162
See application file for complete search history.

(56) References Cited

U.S. PATENT DOCUMENTS

2019/0302656 A1* 10/2019 Ishizumi ..... G03G 15/1615
2019/0332038 A1* 10/2019 Saito ..... G03G 15/5058
2019/0377297 A1* 12/2019 Kent ..... G03G 15/5029
2020/0133171 A1* 4/2020 Ishizumi ..... G03G 15/162

FOREIGN PATENT DOCUMENTS

JP 2005128510 A 5/2005
JP 2010009018 A 1/2010
JP 2015011132 A 1/2015

* cited by examiner

*Primary Examiner* — Sophia S Chen
(74) *Attorney, Agent, or Firm* — Canon U.S.A., Inc. I.P. Division

(57) ABSTRACT

An image forming apparatus which includes a rotary member and a detecting member configured to detect light from a surface of the rotary member. A controller is configured to acquire information relating to a position on the rotary member in a moving direction thereof based on a detection result obtained by the detecting member. The surface of the rotary member has, in a part of the rotary member in its moving direction, an area with a different detection result obtained by the detecting member based on a shape of the surface of the rotary member. The controller acquires the information relating to the position on the rotary member in the moving direction based on the detection result of detecting light from the surface of the rotary member by the detecting member.

15 Claims, 19 Drawing Sheets

IMAGE FORMING APPARATUS INCLUDING A ROTARY MEMBER AND A DETECTING MEMBER WHICH DETECTS LIGHT FROM THE SURFACE OF THE ROTARY MEMBER

BACKGROUND

Field of the Disclosure

The present disclosure generally relates to an image forming apparatus, for example, a printer, a copying machine, or a facsimile apparatus, which uses an electrophotographic system or an electrostatic recording system.

Description of the Related Art

Hitherto, for example, an image forming apparatus using an electrophotographic system has used an image conveying member formed of a rotatable rotary member configured to directly bear and convey a toner image or bear and convey a toner image via a recording material, such as a paper sheet. Examples of the image conveying member configured to directly bear and convey a toner image include a drum-shaped photosensitive member (electrophotographic photosensitive member) and an intermediate transfer member formed of an endless belt. Meanwhile, examples of the image conveying member configured to bear and convey a toner image via a recording material include a recording material beating member formed of an endless belt.

For example, it is known that the circumferential length of the intermediate transfer member changes due to influences of, for example, variations in parts and environmental changes. Thus, it may be desired to dynamically measure the circumferential length of the intermediate transfer member. For example, there is image density control based on an amount of reflection light reflected from a surface (hereinafter also referred to as "background portion") of the intermediate transfer member and an amount of reflection light reflected from a test toner image (hereinafter also referred to as "patch portion") formed on the intermediate transfer member. In order to perform this image density control with high accuracy, it is desired to match a position on the intermediate transfer member for measuring the patch portion with a position on the intermediate transfer member for measuring the background portion. In Japanese Patent Application Laid-Open No. 2010-9018, it is proposed to calculate the circumferential length of the intermediate transfer member by comparing data on the amount of reflection light reflected from the background portion of the intermediate transfer member in its first cycle and data on the amount of reflection light reflected from the background portion of the intermediate transfer member in its second cycle, and to align the positions of the background portion and the patch portion based on the circumferential length.

In the method described in Japanese Patent Application Laid-Open No. 2010-9018, it is possible to calculate the circumferential length (actual circumferential length) of the intermediate transfer member by comparing an output waveform acquired in the first cycle of the intermediate transfer member and an output waveform acquired again after a predetermined time period (second cycle) corresponding to a nominal circumferential length of the intermediate transfer member. However, this output waveform has a range correlating with measurement accuracy of the circumferential length of the intermediate transfer member, and when the output waveform has a small range, it can become difficult to compare the first cycle and the second cycle output waveforms.

SUMMARY

An aspect of the present disclosure is to provide an image forming apparatus capable of accurately acquiring information relating to a position in a circumferential direction of a rotary member configured to bear a toner image directly on its surface or via a recording material.

An image forming apparatus according to one embodiment includes: a rotary member, which is endless and movable, and is configured to bear a toner image directly on a surface of the rotary member or via a recording material; a detecting member configured to detect light from the surface of the rotary member; and a controller configured to acquire information relating to a position on the rotary member in a moving direction of the rotary member based on a detection result obtained by the detecting member, wherein the rotary member has a plurality of grooves along the moving direction on the surface of the rotary member with respect to a width direction of the rotary member perpendicular to the moving direction, and has, with respect to the moving direction, a first area and a second area having a shorter length in the moving direction than the first area, the first area and the second area being different from each other in friction coefficient with respect to the width direction, and wherein the controller acquires the information relating to the position on the rotary member in the moving direction based on a result of detecting, by the detecting member, light from the surface of the rotary member including at least the second area with respect to the moving direction.

Further features of the present disclosure will become apparent from the following description of exemplary embodiments with reference to the attached drawings.

DESCRIPTION OF THE EMBODIMENTS

Now, an image forming apparatus according to the present disclosure is described in detail with reference to the accompanying drawings.

First Embodiment

1. Configuration and Operation of Image Forming Apparatus

Figure 1:
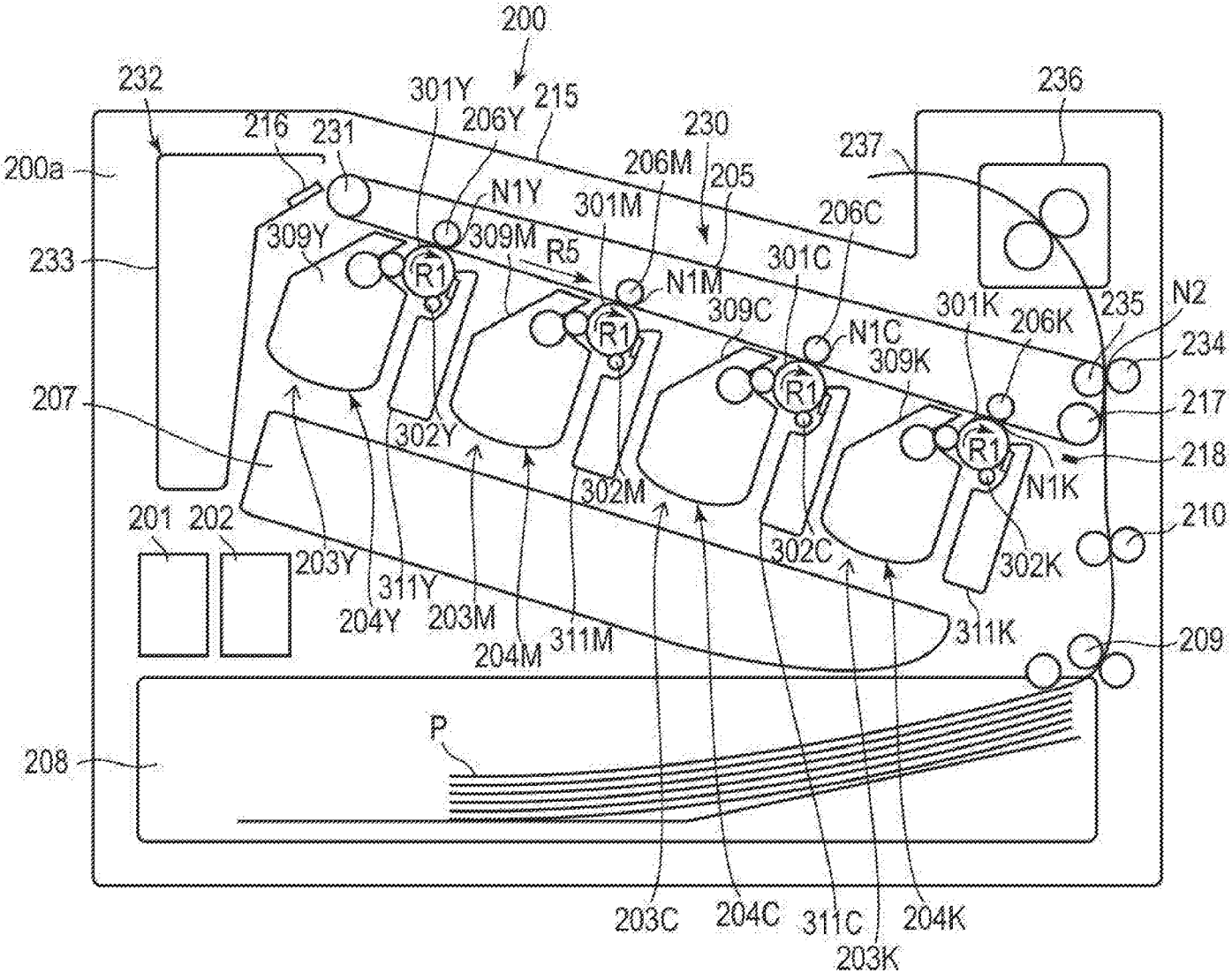
FIG. 1 is a schematic cross-sectional view of an image forming apparatus according to a first embodiment.

FIG. 1 is a schematic cross-sectional view of an image forming apparatus 200 according to a first embodiment. The image forming apparatus 200 according to the first embodiment is a full-color laser printer of a tandem type (in-line system) employing an intermediate transfer system, which is capable of forming a full-color image through use of an electrophotographic system.

The image forming apparatus 200 includes a controller 201 and an engine controller 202. The image forming apparatus 200 is capable of forming a full-color image on a recording material P based on image information input from an external apparatus (not shown), for example, a host computer, to the engine controller 202 via the controller 201. The controller 201 is configured to process the information input from the external apparatus to input the information to the engine controller 202, and to centrally control operations of components of the image forming apparatus 200 via the engine controller 202.

Figure 2:
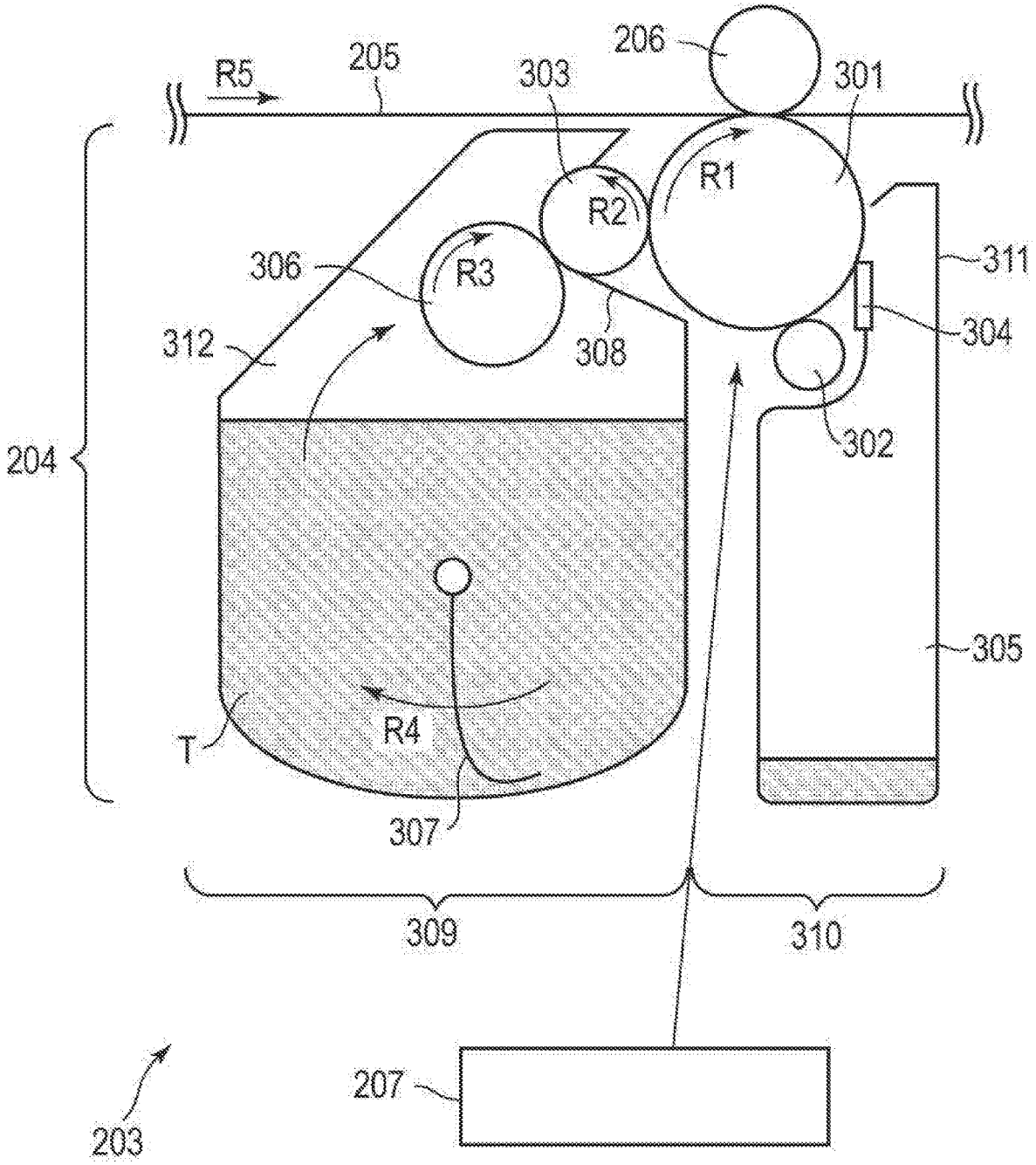
FIG. 2 is a schematic cross-sectional view of an image forming unit.

The image forming apparatus 200 includes, as a plurality of image forming units (stations), four image forming units 203Y, 203M, 203C, and 203K configured to form images in colors of yellow (Y), magenta (M), cyan (C), and black (K), respectively. Components having the same or corresponding functions or configurations in the image forming units 203Y, 203M, 203C, and 203K may be collectively described by omitting Y, M, C, and K, each of which is a suffix to a reference symbol for indicating which color the component is provided for. FIG. 2 is a schematic cross-sectional view for illustrating one of the image forming units 203 in more detail. In the first embodiment, the image forming unit 203 includes, for example, a photosensitive drum 301 (301Y, 301M, 301C, 301K), a charging roller 302 (302Y, 302M, 302C, 302K), an exposure apparatus 207, a developing device 309 (309Y, 309M, 309C, 309K), a primary transfer roller 206 (206Y, 206M, 206C, 206K), and a drum cleaning device 311 (311Y, 311M, 311C, 311K), which are described later. The image forming units 203Y, 203M, 2030, and 203K are arranged side by side along a moving direction (conveying direction) of a surface of an intermediate transfer belt 205 described later.

A drum-shaped (cylindrical-shape) photosensitive member, being a rotatable rotary member, that is, the photosensitive drum 301, which serves as a first image bearing member configured to bear a toner image, is driven to rotate by a drive motor (not shown) serving as a drive unit in a direction indicated by the arrow R1 (clockwise direction) shown in FIG. 1 and FIG. 2. The photosensitive drum 301 has a conductive base layer and a photosensitive layer provided on the base layer, and the base layer is electrically grounded. A surface of the photosensitive drum 301 being rotated is uniformly charged to a predetermined potential of a predetermined polarity (negative polarity in the first embodiment) by the charging roller 302 being a roller-shaped charging member serving as a charging unit. During a charging step, a predetermined charging voltage (charging bias) is applied to the charging roller 302 from a charging power supply (high voltage power supply). The surface of the photosensitive drum 301 that has been charged is scanned and exposed based on image information by the exposure apparatus 207 serving as an exposure unit, and an electrostatic latent image (electrostatic image) corresponding to the image information is formed on the photosensitive drum 301. In the first embodiment, the exposure apparatus 207 is configured as one scanner unit configured to irradiate each of the photosensitive drums 301Y, 301M, 301C, and 301K with laser light. The exposure apparatus 207 irradiates the photosensitive drum 301 with laser light based on the image information input to the engine controller 202 to form an electrostatic latent image on the photosensitive drum 301.

The electrostatic latent image formed on the photosensitive drum 301 is developed (visualized) by supplying toner as a developer by the developing device 309 serving as a developing unit (hereinafter also referred to as "developing unit 309"), and a toner image (developer image) is formed on the photosensitive drum 301. The developing device 309 includes, for example, a developing container 312 containing a toner T, a developing roller 303 serving as a developer carrying member, a toner supplying roller 306 serving as a toner supplying member, a developing blade 308 serving as a regulating member, and a stirring-and-conveying member 307. The developing roller 303 is driven to rotate in a direction indicated by the arrow R2 (counterclockwise direction) shown in FIG. 2 by transmitting a drive force from a drive motor (not show serving as a drive unit. The toner supplying roller 306 is driven to rotate in a direction indicated by the arrow R3 (clockwise direction) shown in FIG. 2 by transmitting a drive force from a drive motor (not shown) serving as a drive unit. The stirring-and-conveying member 307 is driven to rotate in a direction indicated by the arrow R4 (clockwise direction) shown in FIG. 2 by transmitting a drive force from a drive motor (not shown) serving as a drive unit. The toner conveyed toward the toner supplying roller 306 by the stirring-and-conveying member 307 is supplied onto the developing roller 303 by the toner supplying roller 306. The toner supplied onto the developing roller 303 has its layer thickness regulated by the developing blade 308, and is triboelectrically charged by being rubbed by the developing blade 308. The charged toner coating a surface of the developing roller 303 is conveyed to an opposing portion (development position) between the photosensitive drum 301 and the developing roller 303, and adheres to the surface of the photosensitive drum 301 based on the electrostatic latent image. Thus, the electrostatic latent image on the surface of the photosensitive drum 301 is developed as a toner image. During a developing step, a predetermined developing voltage (developing bias) is applied to the developing roller 303 from a developing power supply (high voltage power supply). In the first embodiment, toner charged to the same polarity (negative polarity in the first embodiment) as a charge polarity of the photosensitive drum 301 adheres to an exposed portion (image portion) on the photosensitive drum 301 having an absolute value of the potential lowered by being exposed after being uniformly charged (reverse development). In the first embodiment, a normal charge polarity of the toner, which is the charge polarity of the toner during development, is a negative polarity.

An intermediate transfer unit 230 serving as a belt conveying apparatus is arranged so as to face the four photosensitive drums 301. The intermediate transfer unit 230 includes the intermediate transfer belt 205, which is an intermediate transfer member formed of an endless belt being a rotatable (revolvingly movable) rotary member, as a second image bearing member configured to bear a toner image. The intermediate transfer belt 205 is looped around a drive roller 235, an entrance roller 217, and a tension roller 231, which serve as a plurality of tensioning rollers (support rollers), to be stretched with a predetermined tensile force. The drive roller 235 is configured to transmit a drive force to the intermediate transfer belt 205, and also functions as an opposing member against a secondary transfer roller 234 described later. The entrance roller 217 is arranged so as to be adjacent to the drive roller 235 on an upstream side of the drive roller 235 in the rotational direction of the intermediate transfer belt 205, forms an image transfer surface, and functions as an opposing member against an optical sensor 218 described later. The tension roller 231 applies a predetermined tension to the intermediate transfer belt 205. The intermediate transfer belt 205 is rotated (revolvingly moved) in a direction indicated by the arrow R5 (counterclockwise direction) shown in FIG. 1 and FIG. 2 when the drive roller 235 is driven to rotate by a drive motor (not shown) serving as a drive unit. On an inner peripheral surface side of the intermediate transfer belt 205, primary transfer rollers 206, each of which is a roller-shaped primary transfer member serving as a primary transfer unit, are arranged in association with the respective photosensitive drums 301. The primary transfer roller 206 is pressed toward the photosensitive drum 301 to form a primary transfer portion (primary transfer nip) N1 (N1Y, N1M, N1C, N1K) being a contact portion between the photosensitive drum 301 and the intermediate transfer belt 205. The toner image formed on the photosensitive drum 301 is primarily transferred onto the rotating intermediate transfer belt 205 by the action of the primary transfer roller 206 at the primary transfer portion N1. During a primary transfer step, a primary transfer voltage (primary transfer bias), which is a DC voltage having a polarity reverse to the normal charge polarity of toner, is applied to the primary transfer roller 206 from a primary transfer power supply (high voltage power supply), and a primary transfer electric field is formed at the primary transfer portion N1.

On an outer peripheral surface side of the intermediate transfer belt 205, the secondary transfer roller 234, which is a roller-shaped secondary transfer member serving as a secondary transfer unit, is arranged at a position opposed to a drive roller 235 also serving as a secondary transfer opposing roller. The secondary transfer roller 234 is pressed toward the drive roller 235 through intermediation of the intermediate transfer belt 205 to form a secondary transfer portion (secondary transfer nip) N2 being a contact portion between the intermediate transfer belt 205 and the secondary transfer roller 234. The drive roller 235 is electrically grounded. The toner image formed on the intermediate transfer belt 205 is secondarily transferred onto the recording material (transfer material or sheet) P, for example, a recording sheet, which is conveyed by being nipped between the intermediate transfer belt 205 and the secondary transfer roller 234, by the action of the secondary transfer roller 234 at the secondary transfer portion N2. During a secondary transfer step, a secondary transfer voltage (secondary transfer bias), which is a DC voltage having a polarity reverse to the normal charge polarity of toner, is applied to the secondary transfer roller 234 from a secondary transfer power supply (high voltage power supply), and a secondary transfer electric field is formed at the secondary transfer portion N2. The recording materials P are stacked and stored in a cassette 208 serving as a recording material storage unit, and are separated and fed one by one by a sheet feeding roller 209. The recording material P is conveyed to the secondary transfer portion N2 by a registration roller pair 210 at a timing suitable for the toner image on the intermediate transfer belt 205. Specifically, the recording material P is conveyed to the secondary transfer portion N2 at a timing at which a leading edge portion of the toner image on the intermediate transfer belt 205 in the conveying direction and a leading edge portion of the recording material P in the conveying direction overlap each other.

The recording material P onto which the toner image has been transferred is conveyed to a fixing device 236 serving as a fixing unit. The fixing device 236 is configured to fix (melt and adhere) the toner image on the recording material P by conveying the recording material P bearing the unfixed toner image while heating and pressurizing the recording material P. The recording material P on which the toner image has been fixed is delivered (output) from an outlet 237 onto a delivery tray 215 provided outside an apparatus main body 200*a* of the image forming apparatus 200.

Meanwhile, the toner (primary transfer residual toner) remaining on the photosensitive drum 301 after the primary transfer step is removed and collected from the surface of the photosensitive drum 301 by the drum cleaning device 311 serving as a photosensitive member cleaning unit. The drum cleaning device 311 includes a drum cleaning blade 304, which is a plate-shaped cleaning member formed of an elastic body, and is arranged so as to be brought into abutment with the surface of the photosensitive drum 301, and a drum cleaning container 305. The drum cleaning device 311 is configured to scrape the primary transfer residual toner from the surface of the photosensitive drum 301 by rubbing the surface of the rotating photosensitive drum 301 with the drum cleaning blade 304, and to store the toner in the drum cleaning container 305. In addition, on the outer peripheral surface side of the intermediate transfer belt 205, a belt cleaning device 232 serving as an intermediate transfer member cleaning unit is arranged at a position opposed to the tension roller 231. Adhering substances including the toner (secondary transfer residual toner) remaining on the intermediate transfer belt 205 after the secondary transfer step and paper dust adhering to the surface of the intermediate transfer belt 205 from the recording material P are removed and collected from the surface of the intermediate transfer belt 205 by the belt cleaning device 232. The belt cleaning device 232 includes a belt cleaning blade 216, which is a plate-shaped cleaning member formed of an elastic body, and is arranged so as to be brought into abutment with the surface of the intermediate transfer belt 205, and a belt cleaning container 233. The belt cleaning device 232 is configured to scrape the above-mentioned adhering substances from the surface of the intermediate transfer belt 205 by rubbing the surface of the rotating intermediate transfer belt 205 with the belt cleaning blade 216, and to store the adhering substances in the belt cleaning container 233.

In the first embodiment, in the image forming unit 203, the photosensitive drum 301 is integrated intro a cartridge with the charging roller 302, the developing device 309, and the drum cleaning device 311, which serve as process units that act on the photosensitive drum 301, to thereby form a process cartridge 204. Each process cartridge 204 (204Y, 204M, 204C, 204K) is removably mounted to the apparatus main body 200*a* of the image forming apparatus 200. The process cartridge 204 is formed by combining the developing unit 309 and a drum unit 310 with each other. The developing unit 309 is formed of the above-mentioned developing device 309. Further, the drum unit 310 is formed of, for example, the photosensitive drum 301, the charging roller 302, the drum cleaning blade 304, and the drum cleaning container 305, which are described above.

In addition, in the first embodiment, the intermediate transfer unit 230 includes, for example, the intermediate transfer belt 205 stretched around the plurality of tensioning rollers 235, 217, and 231, the primary transfer rollers 206, and a frame (not shown) for supporting the plurality of tensioning rollers and the primary transfer rollers. The intermediate transfer belt 205 is removably mounted to the apparatus main body 200*a* of the image forming apparatus 200.

2. Intermediate Transfer Belt

Figure 3A:
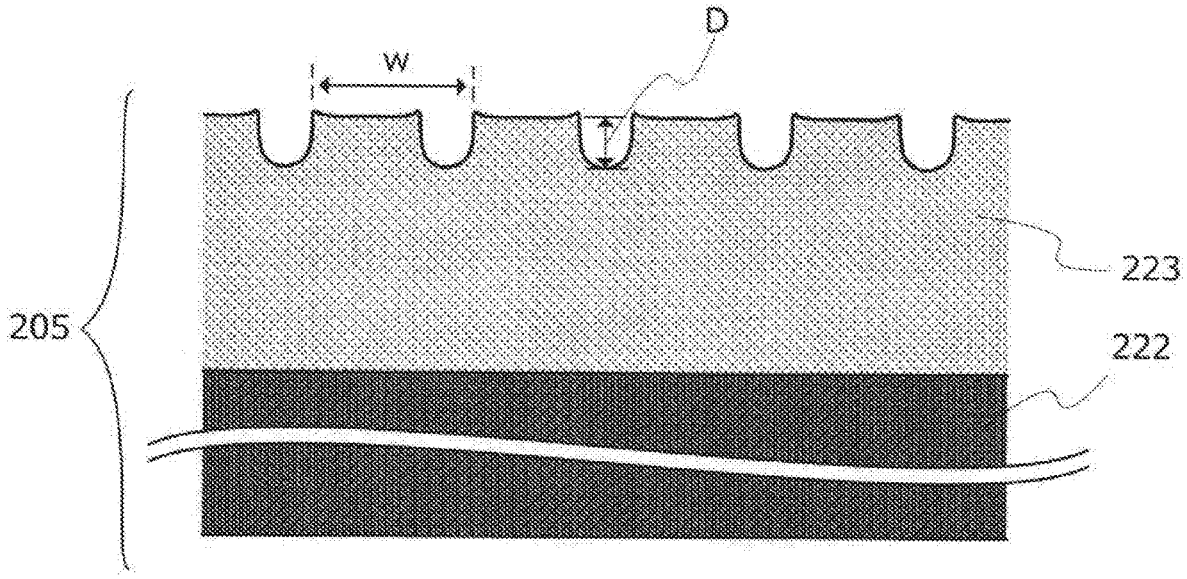
FIG. 3A is a schematic enlarged cross-sectional view of an intermediate transfer belt.

FIG. 3A is a schematic enlarged cross-sectional view of the intermediate transfer belt 205 viewed along the moving direction of the surface of the intermediate transfer belt 205. In the first embodiment, the intermediate transfer belt 205 is formed of an endless belt (film) including a base layer 222 and a surface layer 223.

In the first embodiment, a polyethylene naphthalate resin is used as a base material to form the base layer 222, and carbon black is mixed as a conductive material with the base material to adjust an electric resistance value so as to exhibit a volume resistivity of $1\times10^{10}$ Ω·cm. In addition, in the first embodiment, the base layer 222 has a layer thickness of 70 μm. The base material of the base layer 222 is not limited to the polyethylene naphthalate resin. As the base material of the base layer 222, a thermoplastic resin is commonly used in order to satisfy conditions, for example, that the base material has appropriate charge attenuation characteristics and that the base material has such flex resistance as to deform the base material into a shape suitable for the shape of a member brought into abutment with the intermediate transfer belt 205. Specific examples of the base material include polyimide, polyester, polycarbonate, polyarylate, acrylonitrile butadiene styrene copolymer (ABS), polyphenylene sulfide (PPS), and polyvinylidene fluoride (PVdF), which are used alone or as a mixed resin.

In the first embodiment, an acrylic resin is used as a base material to form the surface layer 223, and zinc oxide is dispersed as an electric resistance adjusting agent in the base material. In addition, in the first embodiment, the surface layer 223 has a layer thickness of about 3 μm. As the base material of the surface layer 223, it is desired to use a resin material (curable resin) among curable materials from the viewpoint of strength, for example, abrasion resistance and crack resistance. In particular, it is desired to use an acrylic resin obtained by curing an unsaturated double bond-containing acrylic copolymer.

In addition, in the first embodiment, the surface (outer peripheral surface) of the intermediate transfer belt 205 is provided with a fine uneven shape in order to, for example, improve the abrasion resistance of the surface of the belt cleaning blade 216 with long-term use. Commonly known processing methods for imparting a fine uneven shape to the surface of the intermediate transfer belt 205 include polishing processing, cutting processing, and imprint processing. In the first embodiment, the imprint processing is employed from the viewpoint of, for example, processing cost, productivity, and accuracy in shape.

Figure 3B:
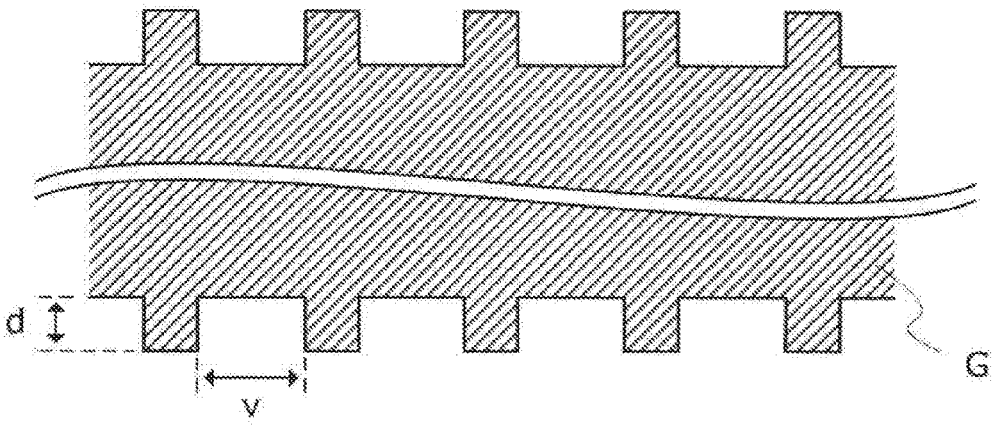
FIG. 3B is a schematic enlarged cross-sectional view of an imprinting mold.

The impartation of a fine uneven shape based on the imprint processing in the first embodiment is further described. At a time of the imprint processing, first, the intermediate transfer belt 205 is pressed into a core (having a diameter of 227 mm and made of carbon tool steel). FIG. 3B is a schematic enlarged cross-sectional view of an imprinting mold (hereinafter also referred to simply as "mold") G for forming a fine uneven shape on the surface of the intermediate transfer belt 205. FIG. 3B is an illustration of a cross-section along a rotational axial direction of the mold G arranged along a width direction substantially perpendicular to a circumferential direction (moving direction) of the intermediate transfer belt 205. The mold G is a substantially columnar member, and protruding portions are formed on an outer peripheral surface of the mold G at predetermined intervals with respect to the axial direction of the mold G substantially parallel to the circumferential direction of the mold G. In the first embodiment, the cutting processing is performed to form protruding portions with substantially regular intervals of 20 μm with respect to the axial direction of the mold G so that a length "v" of a recessed portion (bottom between protruding portions) in the axial direction of the mold G is 2.0 μm and that a height "d" of a protruding portion in a radial direction of the mold G is 2.0 μm.

The mold G is heated by a heater (not shown) to a temperature of 130° C., which is higher than the glass transient temperature of polyethylene naphthalate by 5° C. to 15° C. While the mold G is brought into abutment with the core on which the intermediate transfer belt 205 is fitted as described above, the core is rotated by about one revolution at a circumferential speed of 264 mm/sec, and the mold G is rotated in accordance with the core. After that, the mold G is separated from the core, to thereby obtain the intermediate transfer belt 205 having the surface imparted with a fine uneven shape (to which unevenness of the mold G has been transferred).

The surface shape of the intermediate transfer belt 205 after the imprint processing was observed with a laser microscope VK-X250 manufactured by Keyence Corporation. As a result, it was confirmed that recess-shaped grooves (recessed portions) were formed substantially regularly on the surface of the intermediate transfer belt 205 with substantially regular intervals W of 3.0 μm with respect to the width direction of the intermediate transfer belt 205 and a depth D of 1.0 μm in a thickness direction of the intermediate transfer belt 205. In this case, the above-mentioned interval W can be represented by a length from one end portion (for example, left end portion shown in FIG. 3A) of one protruding portion up to an end portion on the same side of a protruding portion adjacent to the one protruding portion with respect to the width direction of the intermediate transfer belt 205. It was also confirmed that the surface layer 223 of the intermediate transfer belt 205 was scraped off by the imprint processing, and hence there was a burr-like protruding shape on each wall surface of each recessed portion on the surface side (outer side) of the intermediate transfer belt 205. In this case, the above-mentioned depth D can be represented by a depth from an opening portion of the groove to a bottom portion of the groove with respect to the thickness direction of the intermediate transfer belt 205. It suffices that the fine uneven shape is provided in substantially the entire area in contact with the belt cleaning blade 216 in the width direction of the intermediate transfer belt 205.

The fine uneven shape is thus imparted to the surface of the intermediate transfer belt 205, to thereby lower a friction force between the intermediate transfer belt 205 and the belt cleaning blade 216. As a result, abrasion of the belt cleaning blade 216 is suppressed for a long term, and satisfactory cleaning performance is maintained.

Figure 7:
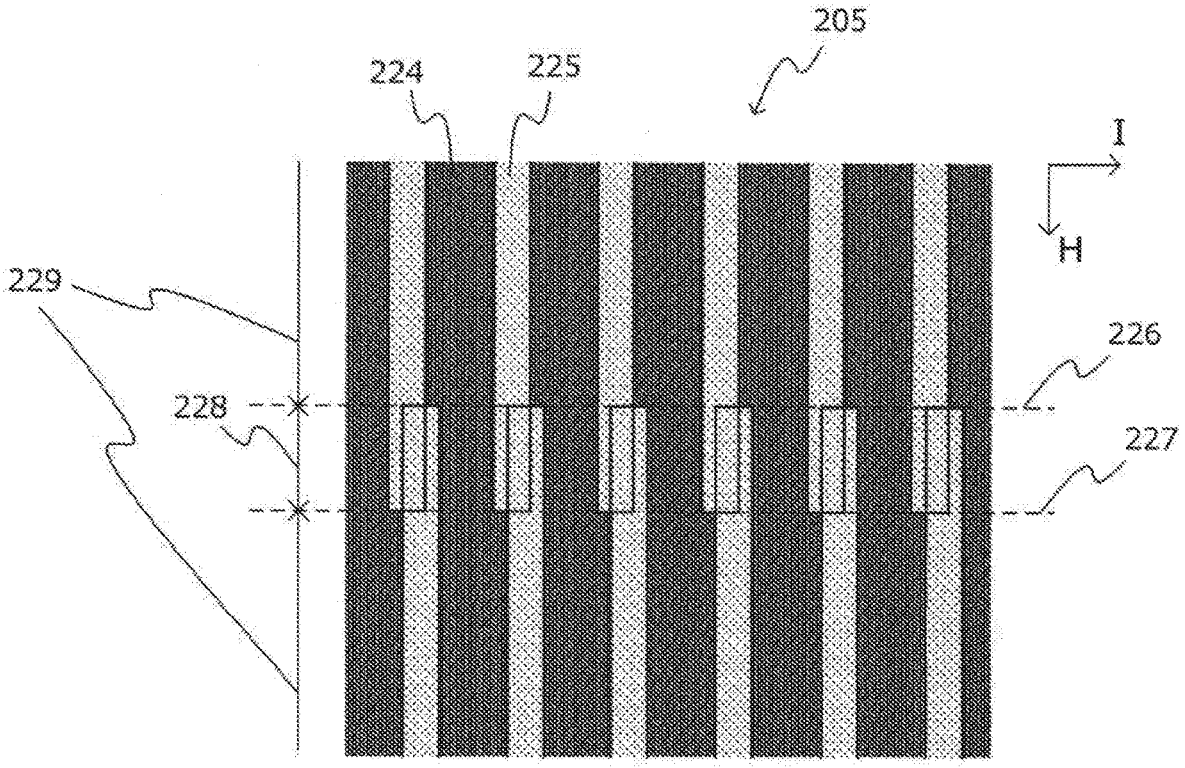
FIG. 7 is a schematic view for illustrating the surface of the intermediate transfer belt in the vicinity of end portions of imprint processing in the first embodiment.

FIG. 7 is an enlarged schematic view of a part of the surface of the intermediate transfer belt 205 (outer peripheral surface). As described above, the imprint processing is performed by rotating the intermediate transfer belt 205 while pressing the mold G against the surface of the intermediate transfer belt 205. Thus, the surface of the imprinted intermediate transfer belt 205 has protruding portions 224 and recessed portions 225, which are substantially uniform (substantially parallel) with respect to a circumferential direction rotational direction) H and periodic with respect to a width direction I substantially perpendicular to the circumferential direction H. The imprint processing is performed along the circumferential direction H from an imprint processing start position 226 up to an imprint processing end position 227. In this case, in the first embodiment, the imprint processing end position 227 does not match the imprint processing start position 226, and is arranged at a position beyond the imprint processing start position 226. Thus, in the first embodiment, an imprint overlapping portion (hereinafter also referred to simply as "overlapping portion") 228 described later, which is an area in which the number of times of imprint processing is larger than in the other area, is formed on the intermediate transfer belt 205 in a part thereof in its circumferential direction. The overlapping portion 228 is an area in which a part of an end portion of each recessed portion 225 on the imprint processing start position 226 side and a part of an end portion of each recessed portion 225 on the imprint processing end position 227 side overlap each other with respect to the circumferential direction of the intermediate transfer belt 205. The area other than the overlapping portion 228 in the circumferential direction of the intermediate transfer belt 205, that is, the area having no overlap in each recessed portion 225 with respect to the circumferential direction of the intermediate transfer belt 205 is set as an imprint non-overlapping portion (hereinafter, also referred to simply as "non-overlapping portion") 229.

There is a high probability that a shift with respect to the width direction I may occur between the end portions of each recessed portion 225 that have an overlap in the overlapping portion 228 with respect to the circumferential direction H. That is, normally, the end portion of each recessed portion 225 on the imprint processing start position 226 side and the end portion of each recessed portion 225 on the imprint processing end position 227 side do not completely overlap each other, and there occurs a shift with respect to the width direction I. This is because, for example, the intermediate transfer belt 205 adversely moves in the width direction I during the imprint processing. When this shift occurs, a ratio of the protruding portions 224 per unit area in the overlapping portion 228 (second area) becomes smaller than that in the non-overlapping portion 229 (first area). In addition, in the overlapping portion 228, the imprint processing is performed more often (twice in the first embodiment) than in the non-overlapping portion 229, and hence a depth of each recessed portion 225 becomes larger than that in the non-overlapping portion 229. That is, typically, the overlapping portion 228 is formed when at least one of an average value of the intervals between the recessed portions 225 in the width direction I or an average value of the depths of the recessed portions 225 is different between the overlapping portion 228 and the non-overlapping portion 229. The overlapping portion 228 may be formed when the recessed portions 225 are formed nonuniformly in the overlapping portion 228 while the recessed portions 225 are formed substantially uniformly in the non-overlapping portion 229. For those reasons, in the overlapping portion 228, an amount of reflection light reflected in a regular reflection direction when the intermediate transfer belt 205 is irradiated with light becomes smaller than in the non-overlapping portion 229. However, the depth of each recessed portion 225 is considerably smaller than the thickness of the intermediate transfer belt 205, and hence there is almost no difference in transferability between the overlapping portion 228 and the non-overlapping portion 229. In short, a normal image to be output by a job can be formed in the same manner in both the overlapping portion 228 and the non-overlapping portion 229.

In the first embodiment, as described later in detail, the circumferential length of the intermediate transfer belt 205 is calculated through use of the above-mentioned decrease in the amount of reflection light at the overlapping portion 228. Details regarding calculation of the circumferential length of the intermediate transfer belt 205, which include how much the amount of reflection light decreases, are described later.

As the number of times of imprint processing becomes smaller, the decrease in the amount of reflection light in the overlapping portion 228 with respect to the amount of reflection light in the non-overlapping portion 229 becomes larger, and the circumferential length of the intermediate transfer belt 205 can be calculated with higher accuracy. In the first embodiment, the imprint processing was performed by about one cycle. However, the imprint processing may be performed by two cycles or more to form the overlapping portion 228 in which the number of times of imprint processing is larger than that in the other area. Even in this case, it is possible to calculate the circumferential length of the intermediate transfer belt 205 in the same manner as in the first embodiment (or to detect a reference position in the same manner as in a second embodiment described later).

In the first embodiment, a nominal circumferential length of the intermediate transfer belt 205 is 790 mm. In addition, in the first embodiment, the length of the overlapping portion 228 with respect to the circumferential direction of the intermediate transfer belt 205 is about 20 mm. The length of the overlapping portion 228 can be set as appropriate, and is preferred to be not too short from the viewpoint of, for example, accuracy of circumferential length measurement of the intermediate transfer belt 205, which is described later. However, the length of the overlapping portion 228 is not required to be set too long from the viewpoint that it suffices to set a relatively short range as an acquisition range of waveform data described later. The length of the overlapping portion 228 is preferred to be, but not limited to, about 5 mm or more and about 50 mm or less, and further preferred to be 10 mm or more and 30 mm or less.

3. Optical Sensor 3-1. Configuration of Optical Sensor

In general, in the electrophotographic image forming apparatus, for example, an image density and a color tone (color reproducibility) of printed matter are changed by a change in electrical characteristics of each part due to various conditions including a usage amount state and a usage environment of a cartridge. Thus, a predetermined test toner image is formed as appropriate, and an image density of the test toner image is fed back to a control mechanism of the image forming apparatus based on a result of measurement using an optical sensor.

Figure 4:
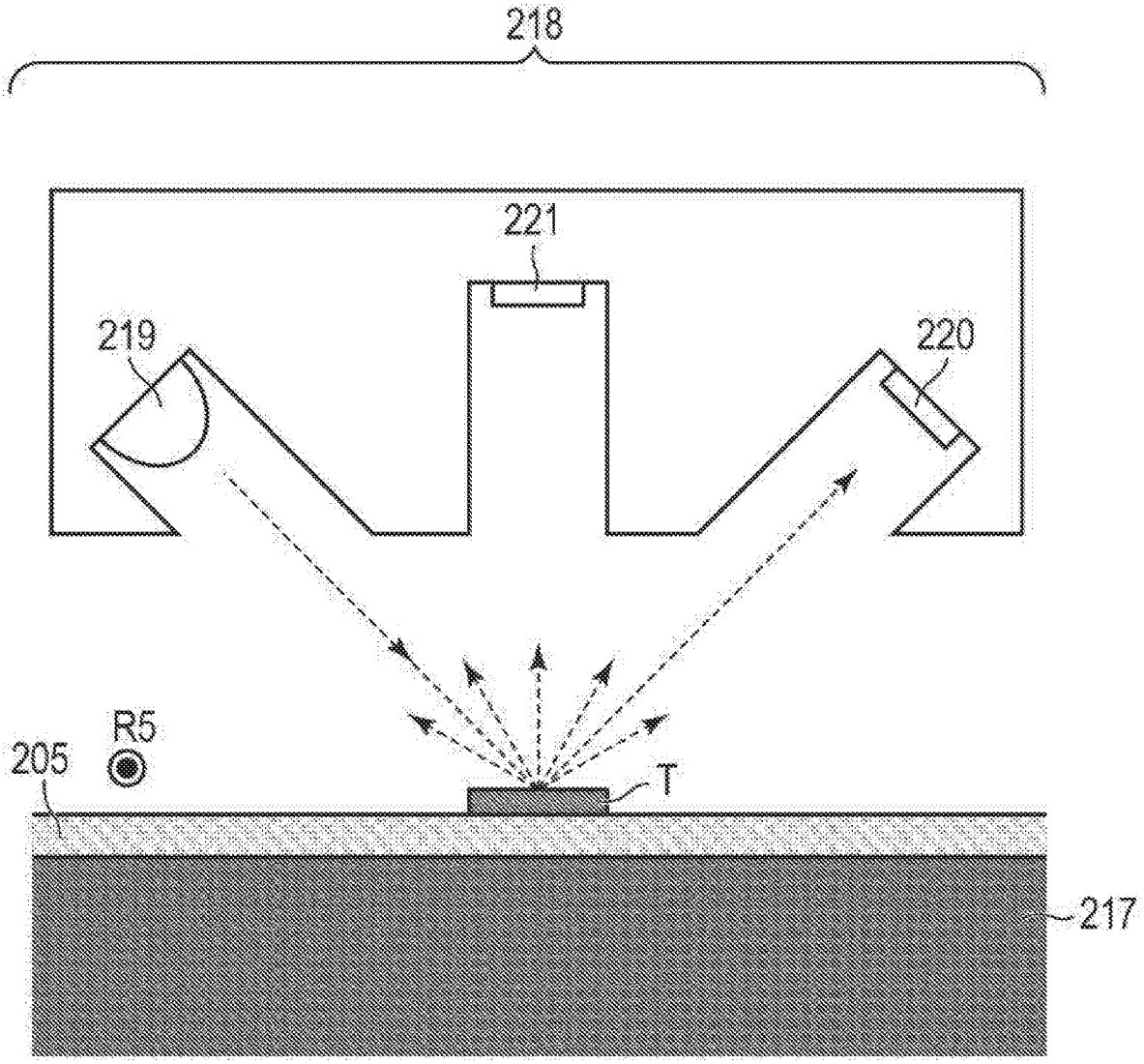
FIG. 4 is a schematic view for illustrating an overall configuration of an optical sensor.

FIG. 4 is a schematic view for illustrating an overall configuration of the optical sensor (density sensor) 218 serving as an optical detecting member in the first embodiment. The toner image is transferred onto the surface of the intermediate transfer belt 205 by the image forming unit 203, and then conveyed to a position on the entrance roller 217 in accordance with the rotation of the intermediate transfer belt 205. The optical sensor 218 is arranged so as to face the entrance roller 217 across the intermediate transfer belt 205. That is, in the first embodiment, the optical sensor 218 is arranged so as to be able to detect light from the intermediate transfer belt 205 at a detection position on a downstream side of the most downstream primary transfer portion N1K and on an upstream side of the secondary transfer portion N2 with respect to the conveying direction of the intermediate transfer belt 205. In this case, the detection position of the optical sensor 218 can be represented by an irradiation position of detection light from the optical sensor 218. In addition, in the first embodiment, the optical sensor 218 is arranged so as to be able to detect light from the surface of the intermediate transfer belt 205 in an image forming area, which is an area capable of bearing a toner image with respect to the width direction of the intermediate transfer belt 205.

The optical sensor 218 includes a light emitting element 219, a regular-reflection-light receiving element 220, and a diffuse-reflection-light receiving element 221. The light emitting element 219 is formed of, for example, a light emitting diode (IED) Further, the regular-reflection-light receiving element 220 and the diffuse-reflection-light receiving element 221 are each formed of, for example, a photodiode (PD). In the first embodiment, the light emitting element 219 is configured to emit infrared light. The light from the light emitting element 219 is reflected by the surface of the intermediate transfer belt 205 or a surface of a toner image (test toner image) T on the intermediate transfer belt 205. The regular-reflection-light receiving element 220 is arranged in the regular reflection direction with respect to the surface of the intermediate transfer belt 205 or the surface of the toner image T, and is configured to detect regular reflection light from the surface of the intermediate transfer belt 205 or the surface of the toner image T. The diffuse-reflection-light receiving element 221 is arranged at a position other than a position in the regular reflection direction with respect to the surface of the intermediate transfer belt 205 or the surface of the toner image T, and is configured to detect diffuse reflection light from the surface of the intermediate transfer belt 205 or the surface of the toner image T. The regular-reflection-light receiving element 220 and the diffuse-reflection-light receiving element 221 are each configured to output a voltage value corresponding to a detected light amount. In this case, the output voltage of the regular-reflection-light receiving element 220 and the output voltage of the diffuse-reflection-light receiving element 221 are also referred to as "regular reflection output" and "diffuse reflection output", respectively. In addition, the output voltage calculated from the regular reflection output and the diffuse reflection output in such a manner as described later is also referred to simply as "sensor output". In addition, as described above, the surface of the intermediate transfer belt 205 is also referred to as "background portion", and the test toner image formed on the intermediate transfer belt 205 is also referred to as "patch portion".

3-2. Measurement at Background Portion

Figure 5A:
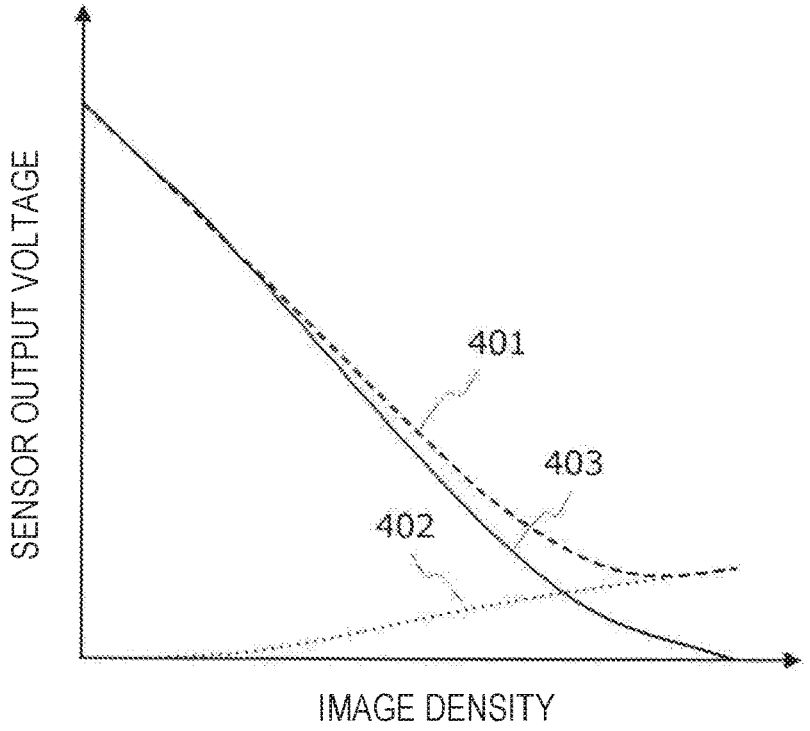
FIG. 5A is a graph for showing a sensor output voltage with respect to an image density.

FIG. 5A is a graph for showing an example of a regular reflection output fluctuation 401, a diffuse reflection output fluctuation 402, and a sensor output fluctuation 403 with respect to the image density of the toner image T. When the image density of the toner image T is low (when the toner amount is small), a large amount of reflection from the surface of the intermediate transfer belt 205, which is a substantially smooth mirror surface, is detected, and hence the regular reflection output becomes larger. As the image density of the toner image T increases (as the toner amount increases), the regular reflection output decreases. When the number of toner layers of the toner image T is one or more, regular reflection components from the surface of the intermediate transfer belt 205 are almost eliminated. However, the regular reflection output includes diffuse reflection components in addition to the regular reflection components, and hence the regular reflection output does not monotonously decrease in an area in which the image density of the toner image T is high. Meanwhile, the diffuse reflection output monotonously increases in accordance with the image density (toner amount) of the toner image T, but the change amount is smaller than the regular reflection output. The sensor output fluctuation 403 having a correlation with the image density of the toner image T from a low density range to a high density range is obtained by obtaining a sensor output obtained by removing, from the regular reflection output, the diffuse reflection components obtained based on the diffuse reflection output.

Figure 5B:
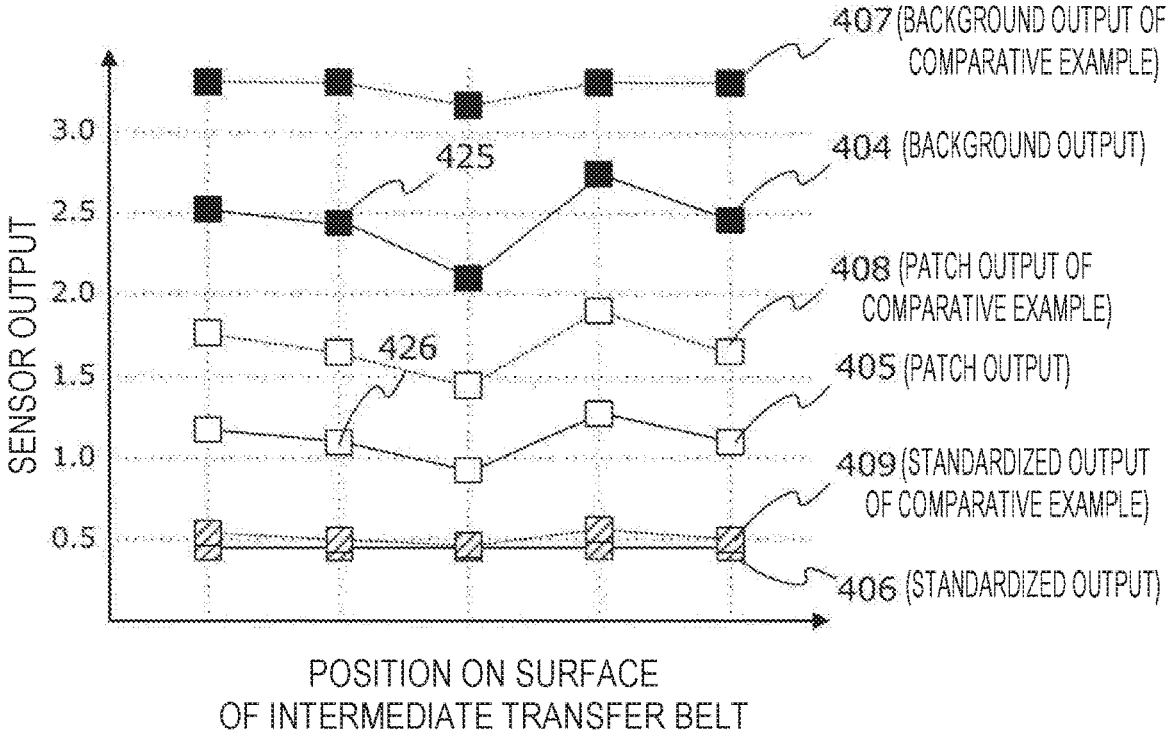
FIG. 5B is a graph for showing a sensor output with respect to a position on a surface of the intermediate transfer belt.

FIG. 5B shows an example of background outputs 404 at a plurality of spots (five spots in the shown example) in the circumferential direction of the intermediate transfer belt 205 and patch outputs 405 at the same positions. In this case, the "background output" represents a sensor output (that is, sensor output of "background portion") in a state in which there is no toner, and the "patch output" represents a sensor output (that is, sensor output of "patch portion") in a state in which there is toner. The background output 404 fluctuates depending on a position in the circumferential direction on the intermediate transfer belt 205. Specifically, reflectance and a surface shape locally differ depending on the position in the circumferential direction on the intermediate transfer belt 205, and hence the regular reflection output changes, and as a result, the background output 404 fluctuates. In addition, the patch output 405 is obtained at all the positions by detecting the toner image T formed with the same halftone density, but in the same manner as with the background output 404, fluctuates depending on the position in the circumferential direction on the intermediate transfer belt 205. Thus, when image density control (image density correction and color tone adjustment) is performed based on the patch output 405 itself, the accuracy of the image density control deteriorates due to the fluctuation of the background output 404. When the background output fluctuates to its high side, the patch output also fluctuates to its high side, and when the background output fluctuates to its low side, the patch output also fluctuates to its low side. Thus, by standardizing the patch output with the background output, it is possible to cancel a local fluctuation due to the position in the circumferential direction on the intermediate transfer belt 205. Specifically, the patch output is divided by the background output to obtain a standardized output. FIG. 5B shows a standardized output 406 obtained by dividing the above-mentioned patch output 405 by the above-mentioned background output 404. The patch output 405 at the five points shown in FIG. 5B has an average value of 1.112 V and a standard deviation of 0.112, and the standardized output 406 at the five points shown in FIG. 5B has an average value of 0.453 V and a standard deviation of 0.005. In this case, a value obtained by dividing the standard deviation by the average value is set as an index value for evaluating the fluctuation of the output. In the patch output 405 shown in FIG. 5B, this index value is 0.100, and in the standardized output 406, this index value is 0.010. It can be understood that the standardized output 406 exhibits a less fluctuation than the patch output 405.

As described above, by obtaining the standardized output 406, it is possible to cancel the fluctuation in the sensor output due to the position in the circumferential direction on the intermediate transfer belt 205. However, in order to achieve this, it is desired to accurately align the positions in the circumferential direction on the intermediate transfer belt 205 for respectively acquiring the patch output and the background output. In the first embodiment, the positions in the circumferential direction on the intermediate transfer belt 205 for respectively acquiring the background output and the patch output are accurately matched based on the circumferential length of the intermediate transfer belt 205. That is, in order to accurately acquire the standardized output, it is desired to acquire the background output and the patch output at the same position with respect to the circumferential direction of the intermediate transfer belt 205. At this time, in order to identify the same position on the intermediate transfer belt 205, it is desired to know the circumferential length of the intermediate transfer belt 205. This is because a time period required for the specific position on the intermediate transfer belt 205 to make one cycle is obtained by dividing the circumferential length of the intermediate transfer belt 205 by the circumferential speed (process speed) of the intermediate transfer belt 205. However, the circumferential length of the intermediate transfer belt 205 changes due to, for example, variations in the parts and an atmospheric environment of the image forming apparatus 200. That is, when the circumferential length of the intermediate transfer belt 205 is handled as a fixed value, an error occurs in identification of the position. In view of this, it is desired to dynamically measure the circumferential length of the intermediate transfer belt 205. A specific method for the circumferential length measurement for the intermediate transfer belt 205 in the first embodiment is described later.

3-3. Measurement at Patch Portion

Figure 6A:
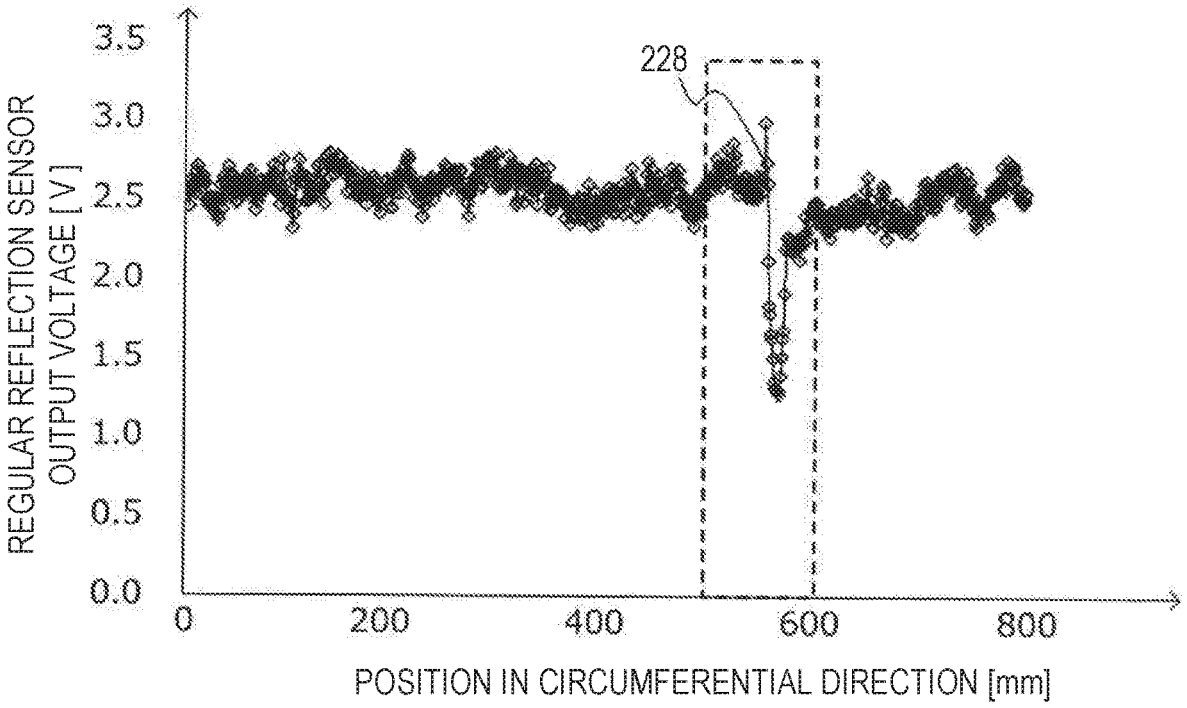
FIG. 6A is a graph for showing a regular reflection output voltage with respect to a position in a circumferential direction on the intermediate transfer belt in the first embodiment.
Figure 6B:
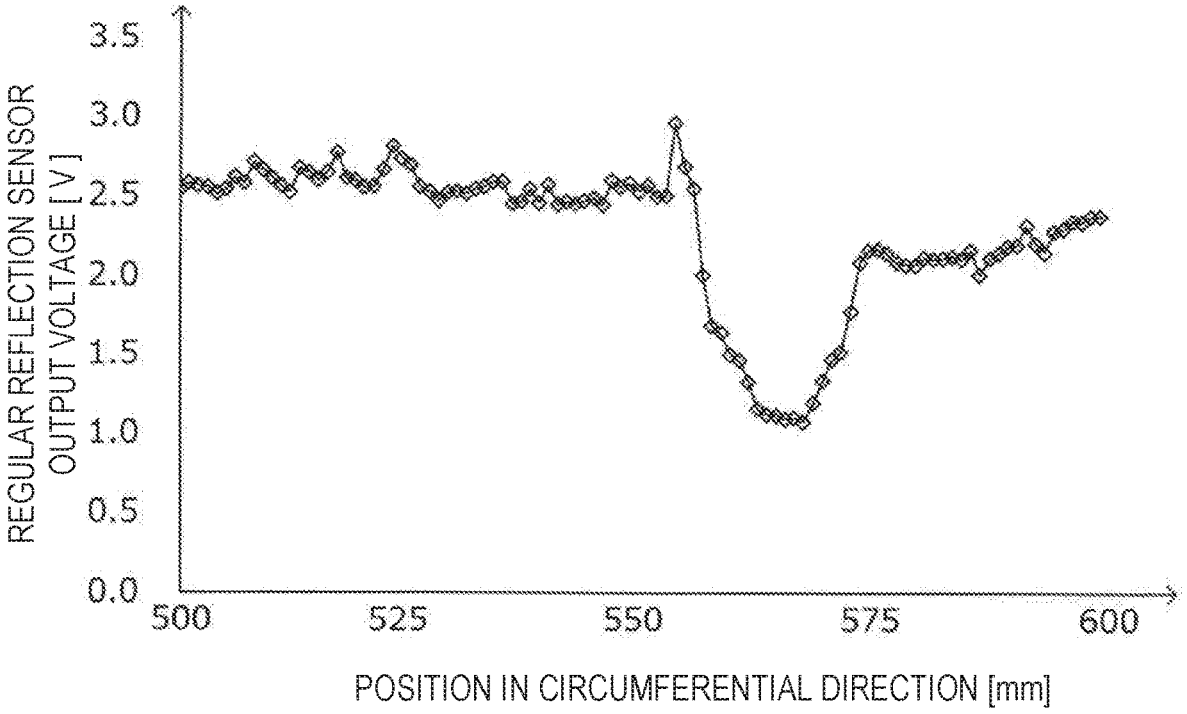
FIG. 6B is a graph for showing a regular reflection output voltage in the vicinity of an overlapping portion.

FIG. 6A is a graph for showing an example of the regular reflection output corresponding to about one cycle of the intermediate transfer belt 205. As described above, the regular reflection output fluctuates depending on the position in the circumferential direction on the intermediate transfer belt 205. In addition, the regular reflection output in the vicinity of the overlapping portion 228 is greatly reduced. FIG. 6B is a graph for showing the regular reflection output in the vicinity of the overlapping portion 228 shown in FIG. 6A. The regular reflection output is about 2.5 V over the entire circumferential length of the intermediate transfer belt 205, while the regular reflection output drops to about 1.3 V in the vicinity of the overlapping portion 228. When the regular reflection output is small, the dynamic range becomes smaller, and hence an influence of noise is easily exerted, to thereby cause the accuracy of the image density control to be liable to deteriorate. It is possible to increase the regular reflection output by increasing a light emission amount of the light emitting element 219 or raising a gain value of the regular-reflection-light receiving element 220. However, the regular reflection output is saturated in an area other than the vicinity of the overlapping portion 228, and hence there is a limit.

FIG. 5B shows, as Comparative Example, a background output 407, a patch output 408, and a standardized output 409, which are obtained when the gain value of the regular-reflection-light receiving element 220 is increased until the sensor output is saturated to an upper limit value of 3.3 V In the background output 407 of Comparative Example, most of the background outputs 407 at the five points are saturated to the upper limit value of 3.3 V, and hence the fluctuation due to the position in the circumferential direction on the intermediate transfer belt 205 is not visible. Meanwhile, the patch output 408 of Comparative Example is not large enough to saturate at the upper limit value of 3.3 V, and hence the fluctuation due to the position in the circumferential direction on the intermediate transfer belt 205 is amplified. Thus, even in the standardized output 409 of Comparative Example, the fluctuation due to the position in the circumferential direction on the intermediate transfer belt 205 appears. Specifically, the background output 407 of Comparative Example has an average value of 3.270 V and a standard deviation of 0.067, and the patch output 408 of Comparative Example has an average value of 1.668 V and a standard deviation of 0.168. In addition, the standardized output 409 of Comparative Example has an average value of 0.510 V and a standard deviation of 0.044. In the same manner as described above, when the value obtained by dividing the standard deviation by the average value is calculated as the index value for evaluating the fluctuation of the output, the index value is 0.100 in the patch output 408 of Comparative Example, and is 0.086 in the standardized output 409 of Comparative Example. The fluctuation of the standardized output 409 of Comparative Example is smaller than the fluctuation of the patch output 408 of Comparative Example, but a change corresponding to the fluctuation is smaller than a change between the fluctuation of the patch output 405 and the fluctuation of the standardized output 406 in the above-mentioned example. In short, it is understood that Comparative Example exhibits a large error.

As described above, in order to accurately perform the image density control, it is desired to avoid arranging the test toner image for the image density control in the overlapping portion 228. A specific flow of the image density control in the first embodiment is described later.

4. Control Mode

Figure 19A:
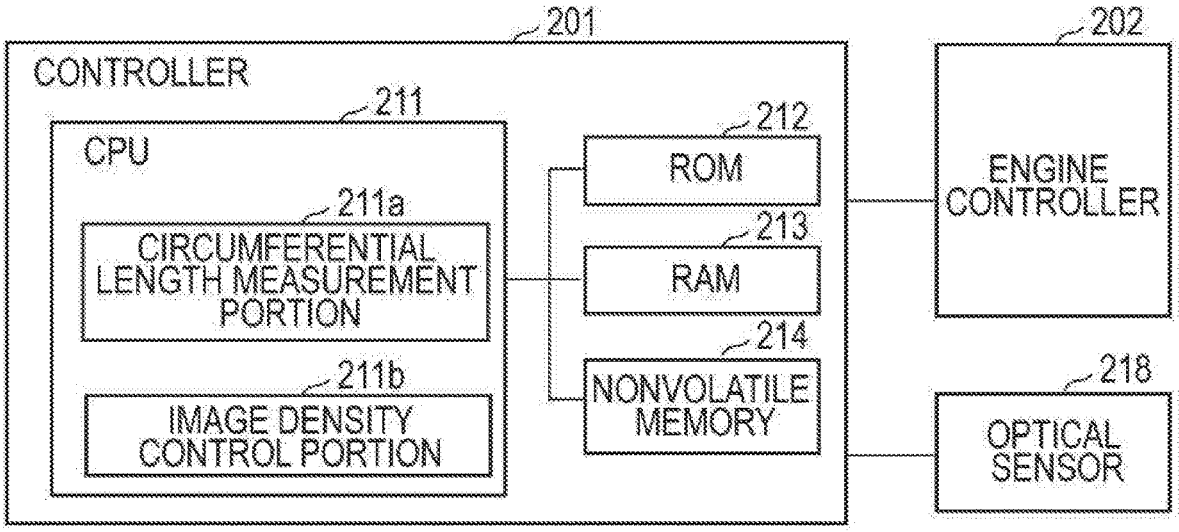
FIG. 19A is a schematic block diagram for illustrating an example of a control mode for a main part of the image forming apparatus according to the first embodiment.

FIG. 19A is a schematic block diagram for illustrating a control mode for a main part of the image forming apparatus 200 according to the first embodiment. The controller 201 serving as a control unit (control portion) included in the image forming apparatus 200 includes, for example, a CPU 211 serving as an arithmetic/logic operation control unit, a ROM 212 serving as a storage unit, a RAM 213, and a nonvolatile memory 214. The CPU 211 is configured to use the RAM 213 as a work area to control each component of the image forming apparatus 200 based on various control programs stored in the ROM 212. The ROM 212 stores, for example, the various control programs, various kinds of data, and tables. In the RAM 213, for example, a program loading area, a work area for the CPU 211, and a storage area for the various kinds of data are secured. The nonvolatile memory 214 stores various kinds of data including information on the circumferential length of the intermediate transfer belt 205 and a lookup table, which are described later. The engine controller 202 is configured to control, for example, a motor for driving each component, an image writing timing, and various biases based on instructions issued by the CPU 211 of the controller 201.

As illustrated in FIG. 19A, in the first embodiment, the CPU 211 includes, as its feature functions, a circumferential length measurement portion 211*a* and an image density control portion 211*b*. The CPU 211 loads the control program stored in the ROM 212 into the RAM 213 to execute processing, to thereby achieve functions of, for example, the circumferential length measurement portion 211*a* and the image density control portion 211*b*, and also has a timer function for measuring time. As described later in detail, the circumferential length measurement portion 211*a* is configured to measure the circumferential length of the intermediate transfer belt 205 based on data acquired from the intermediate transfer belt 205 by the optical sensor 218. In addition, as described later in detail, the image density control portion 211*b* is configured to adjust image formation conditions based on the information on the circumferential length of the intermediate transfer belt 205 obtained by the circumferential length measurement portion 211*a* and data acquired from the test toner image for the image density control by the optical sensor 218.

In the first embodiment, an example in which the CPU 211 executes the circumferential length measurement and the image density control is described. However, the present disclosure is not limited thereto, and when, for example, an application-specific integrated circuit (ASIC) or a system on chip (SOC) is mounted to the image forming apparatus, the ASIC or the SOC may be caused to execute a part or all of the processing for the circumferential length measurement and the image density control. In this case, the SOC represents a chip in which a CPU and an ASIC are integrally provided in the same package. In this manner, when the circumferential length measurement and the image density control are executed by the ASIC, the processing load on the CPU 211 can be reduced.

In this case, the image forming apparatus 200 executes a job (print job) being a series of operations for forming and outputting an image on a single or a plurality of recording materials P, which is started by one start instruction. In general, the job includes an image forming step, a pre-rotation step, a sheet interval step to be applied when images are formed on a plurality of recording materials P, and a post-rotation step. The image forming step is a period during which an electrostatic image of an image to be actually formed on the recording material P and output is formed, a toner image is formed, and a primary transfer and a secondary transfer of the toner image are performed. An image formation time (image formation period) represents the above-mentioned period. More specifically, timings during the image formation time differ among positions for performing the above-mentioned steps of forming the electrostatic image, forming the toner image, and performing the primary transfer and the secondary transfer of the toner image. The pre-rotation step is a period during which a preparation operation before the image forming step is performed after the start instruction is input until the image formation is actually started. The sheet interval step is a period corresponding to an interval between a recording material P and another recording material P, which is exhibited when the image formation is continuously performed on a plurality of recording materials P (continuous image formation). The post-rotation step is a period during which a cleanup operation (preparation operation) following the image forming step is performed. An image non-formation time (image non-formation period) represents a period other than the image formation time, and includes, for example, the pre-rotation step, the sheet interval step, and the post-rotation step, which are described above, and also a pre-multi rotation step being a preparation operation to be performed when the image forming apparatus 200 is powered on or recovered from a sleep state.

5. Image Density Control 5-1. Flow of Image Density Control

In the first embodiment, the image forming apparatus 200 executes the image density control (image density correction and color tone adjustment) during the image non-formation time in order to obtain originally correct image density and color tone (color reproducibility) of the printed matter. In the first embodiment, in the image density control, a plurality of test toner images (test toner images at a plurality of levels of gray in each color) are tentatively formed while the image formation conditions are changed, and the image formation conditions are adjusted based on a result of detecting the image density of the test toner image by the optical sensor 218. The image formation conditions include conditions for a charging voltage, an exposure intensity, a developing voltage, and other such factors and setting of a lookup table to be performed when an input signal from the host side at a time of forming a halftone image is converted into output image data. The image density and the color tone (color reproducibility) fluctuate due to, for example, a change of a usage environment and a usage history of various consumables, and hence it is desired to execute the image density control periodically in order to stabilize the image density and the color tone. The first embodiment is described by taking an example in which the image formation conditions are adjusted by correcting the lookup table in the image density control.

Figure 8:
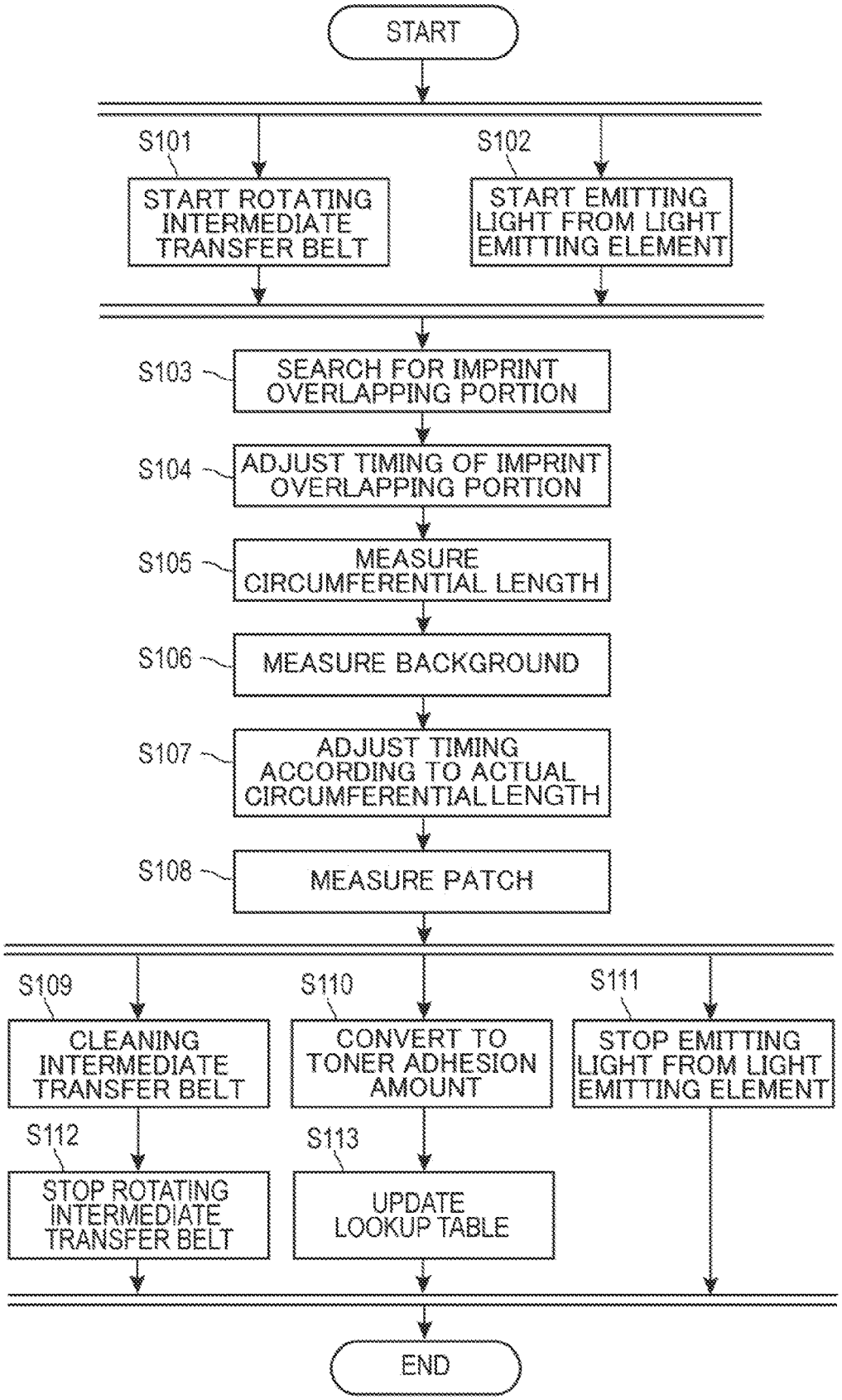
FIG. 8 is a flow chart for illustrating an outline of a procedure for image density control in the first embodiment.

FIG. 8 is a flow chart for illustrating an outline of a flow of the image density control in the first embodiment.

First, the controller 201 (image density control portion 211*b*) controls the intermediate transfer belt 205 to start its rotation (Step S101), and in parallel with this, controls the light emitting element 219 of the optical sensor 218 to emit light (Step S102). Subsequently, the controller 201 controls to search for the overlapping portion 228 of the intermediate transfer belt 205 (Step S103). Specifically, the controller 201 monitors the regular reflection output of the optical sensor 218 while rotating the intermediate transfer belt 205, and obtains a timing at which such a local drop in the regular reflection output as shown in FIGS. 6A and 6B is detected. More specifically, the controller 201 detects at least one of an overlapping portion leading edge timing or an overlapping portion trailing edge timing, for example, in the same manner as described later in the second embodiment.

Subsequently, the controller 201 (image density control portion 211*b*) waits until the overlapping portion 228 retrieved in Step S103 through the search next reaches the detection position of the optical sensor 218 (Step S104). Specifically, the controller 201 waits for a time period corresponding to about one cycle based on the nominal circumferential length (790 mm in the first embodiment) of the intermediate transfer belt 205 after the timing at which the local drop is detected by the optical sensor 218 in Step S103. The timing (time) is not required to be the time of a clock, and may be a count value of a timer. Subsequently, the controller 201 (circumferential length measurement portion 211*a*) executes the circumferential length measurement for the intermediate transfer belt 205 in accordance with the timing at which the overlapping portion 228 reaches the detection position of the optical sensor 218 (Step S105). Details of the circumferential length measurement for the intermediate transfer belt 205 in Step S105 are described later.

Subsequently, the controller (image density control portion 211*b*) acquires a background output from the optical sensor 218 (Step S106). Specifically, as described later in detail, the controller 201 acquires the background output at a timing that does not overlap the overlapping portion 228 based on the timing at which the overlapping portion 228 is detected in Step S103 and the circumferential length of the intermediate transfer belt 205 obtained in Step S105. Subsequently, the controller 201 adjusts a timing of acquiring a patch output (timing adjustment) based on the circumferential length of the intermediate transfer belt 205 obtained in Step S105 (Step S107). Specifically, as described later in detail, the controller 201 adjusts a timing of forming the test toner image and a timing of acquiring the patch output so as to acquire the patch output at the same position as the position at which the background output is acquired in Step S106 with respect to the circumferential direction of the intermediate transfer belt 205. Such position (timing) control is performed through use of the circumferential length of the intermediate transfer belt 205 obtained in Step S105. That is, the image density control portion 211*b* acquires the patch output at the timing at which a time period corresponding to the circumferential length of the intermediate transfer belt 205 obtained by the circumferential length measurement portion 211*a* has elapsed since the timing of acquiring the background output. Thus, the background output and the patch output that have been acquired at the same position can be associated with each other. The timing (time) is not required to be the time of a clock, and may be a count value of a timer. In this manner, the image density control portion 211*b* and the circumferential length measurement portion 211*a* can function to identify the same position on the intermediate transfer belt 205 through use of the information on the circumferential length of the intermediate transfer belt 205. Then, the controller 201 (image density control portion 211*b*) acquires the patch output from the optical sensor 218 in accordance with the timing adjusted in Step S107 (Step S108).

Subsequently, when the acquisition of the patch output is completed, the controller 201 removes the toner on the intermediate transfer belt 205 (Step S109), and then controls the intermediate transfer belt 205 to stop its rotation (Step S112). Specifically, the controller 201 causes the test toner image to pass through the secondary transfer portion N2, removes the test toner image by the belt cleaning device 232, and then stops rotating the intermediate transfer belt 205. The test toner image can be caused to pass through the secondary transfer portion N2 by applying a voltage having the same polarity as the normal charge polarity of the toner (polarity reverse to that at a time of secondary transfer) to the secondary transfer roller 234 or by separating the secondary transfer roller 234 from the intermediate transfer belt 205. In parallel with the processing of Step S109 and Step S112, the controller 201 (image density control portion 211*b*) calculates the image density of the test toner image based on the standardized output obtained from the acquired background output and patch output (Step S110). Then, the controller 201 (image density control portion 211*b*) updates the lookup table in order to perform the color tone adjustment on the printed matter (Step S113). That is, the image density control portion 211*b* obtains the standardized output regarding each level of gray in each color in the above-mentioned manner from the patch output acquired from the test toner image at each level of gray in each color and the corresponding background output. In addition, a coefficient and a table that are obtained in advance and stored in the ROM 212 are used to convert the standardized output regarding each level of gray in each color into the toner adhesion amount or image density regarding each level of gray in each color. Then, the image density control portion 211*b* updates the lookup table so that a result of conversion into the toner adhesion amount or image density in each level of gray has a value corresponding to each original level of gray in terms of each color, and stores the lookup table in the nonvolatile memory 214. In parallel with the processing of Step S109, Step S112, Step S110, and Step S113, the controller 201 controls the light emitting element 219 to stop emitting light at a predetermined timing (Step S111).

5-2. Circumferential Length Measurement

As described above, in order to measure the reflection light corresponding to each of presence and absence of toner at the same position on the intermediate transfer belt 205, it is desired to accurately grasp the circumferential length of the intermediate transfer belt 205. When it is possible to measure the circumferential length of the intermediate transfer belt 205 after expansion or contraction or an amount of the expansion or contraction of the intermediate transfer belt 205, it is possible to calculate a time period required for one cycle of a freely-set position on the intermediate transfer belt 205 based on the circumferential length after the expansion or contraction or the amount of the expansion or contraction and the process speed. The calculated time period required for one cycle of the freely-set position corresponds to a cycle in which the freely-set position on the intermediate transfer belt 205 passes through the detection position of the optical sensor 218. Thus, when the cycle of the intermediate transfer belt 205 is counted by the timer, the count value of the timer indicates an absolute position on the intermediate transfer belt 205.

Hitherto, as a method of measuring the circumferential length of an intermediate transfer belt, the above-mentioned method described in Japanese Patent Application Laid-Open No. 2010-9018 has been available. In the method described in Japanese Patent Application Laid-Open No. 2010-9018, the reflection light (regular reflection light) from the surface of the intermediate transfer belt is detected through use of an optical sensor, and a waveform (hereinafter also referred to as "waveform data") of the output (regular reflection output) of the optical sensor regarding the surface of the intermediate transfer belt is acquired to calculate the circumferential length of the intermediate transfer belt. In this method, the sampling of the reflection light from the surface of the intermediate transfer belt by the optical sensor is divided into the first cycle and the second cycle of the intermediate transfer belt to be executed with a fixed interval based on the nominal circumferential length of the intermediate transfer belt. In this case, the waveform data on the second cycle is acquired at a timing different from that of the first cycle so as to have a larger sampling number than that of the first cycle and include the waveform data on the first cycle. This is because of taking into consideration the fact that the circumferential length of the intermediate transfer belt fluctuates with respect to the nominal circumferential length due to the variations in parts and the environmental changes. Then, the waveform data on the first cycle is compared (collated) with the waveform data on the second cycle while being shifted, and a matching degree of the waveform data is calculated within a preset fluctuation range of the circumferential length of the intermediate transfer belt. As a result, the circumferential length of the intermediate transfer belt is calculated based on a shift amount of the waveform data on the first cycle in a case of the highest matching degree (that is, shift amount of the circumferential length of the intermediate transfer belt from the nominal circumferential length). It is possible to obtain the above-mentioned shift amount with which the waveform data on the first cycle and the waveform data on the second cycle best match by obtaining a shift amount with which an integrated value of absolute values of a difference between the waveform data on the first cycle and the waveform data on the second cycle is minimized.

In the first embodiment, on the intermediate transfer belt 205, an area exhibiting no peculiarity in terms of transferability but an optical peculiarity is present in a part of the intermediate transfer belt 205 in the circumferential direction of the intermediate transfer belt within the image forming area on the intermediate transfer belt 205 in the width direction. In the first embodiment, the area on the intermediate transfer belt 205 exhibiting an optical peculiarity is the overlapping portion 228. Then, in the first embodiment, the overlapping portion 228 of the intermediate transfer belt 205 is used to acquire information relating to the position in the circumferential direction on the intermediate transfer belt 205, in particular, information relating to the circumferential length of the intermediate transfer belt 205. In the first embodiment, in the same manner as in the method described in Japanese Patent Application Laid-Open No. 2010-9018, the circumferential length of the intermediate transfer belt 205 is measured based on "matching" in which the waveform data on the surface of the intermediate transfer belt 205 is compared (collated) to calculate the matching degree. However, in the first embodiment, the area for acquiring the waveform data with respect to the circumferential direction of the intermediate transfer belt 205 is set as an area including the overlapping portion 228.

In this case, the information relating to the position in the circumferential direction on the rotary member (intermediate transfer belt 205) includes freely-set information including information relating to the circumferential length of the rotary member, which is used for grasping a freely-set position on the rotary member in the circumferential direction, which may fluctuate due to any cause, or a timing at which the above-mentioned freely-set position passes through a freely-set index position, for example, the detection position of the optical sensor. In addition, the information relating to the circumferential length of the rotary member (intermediate transfer belt 205) includes freely-set information for grasping the circumferential length of the rotary member that may fluctuate due to any cause, the freely-set information being required for identifying or detecting the same position as a position at a given time, after a given time period while the rotary member is being rotated. Examples thereof may include digital data (count value) indicating an actual circumferential length of the rotary member and digital data (count value) indicating a time actually required for rotating the rotary member a predetermined number of times (for example, by one cycle). The information relating to the circumferential length of the rotary member may be, in addition to the information indicating the actual circumferential length of the rotary member itself, for example, a length (difference between nominal circumferential length and actual circumferential length) by which the actual circumferential length is expanded or contracted from the nominal circumferential length (ideal dimension value obtained when there are no manufacturing tolerances or environmental fluctuations).

In addition, in the first embodiment, the information relating to the position on the intermediate transfer belt in particular, the information relating to the circumferential length of the intermediate transfer belt 205 is used to perform control (phase control) required to identify the position in the circumferential direction on the intermediate transfer belt 205 or a timing corresponding to the position, or more particularly, to perform control (timing adjustment) for a timing to acquire the output (background output and patch output) of the optical sensor 218 in the image density control in the first embodiment.

At the overlapping portion 228, the output (regular reflection output) of the optical sensor 218 changes sharply. Thus, the difference between the waveform data on the first cycle and the waveform data on the second cycle becomes more conspicuous, to thereby improve the measurement accuracy of the circumferential length of the intermediate transfer belt 205. When the light amount of the optical sensor 18 is stable to some extent, the difference between the waveform data on the first cycle and the waveform data on the second cycle can be detected with sufficient accuracy. In addition, the difference between the waveform data on the first cycle and the waveform data on the second cycle can be detected with sufficient accuracy by measuring a relatively short range in the circumferential direction of the intermediate transfer belt 205 including the overlapping portion 228. Thus, it is possible to reduce the down time by reducing a time period for waiting for the light amount of the optical sensor 218 to become stable or calculating the circumferential length. In addition, the information within the image forming area on the intermediate transfer belt 205 may be acquired by also using the optical sensor configured to detect the test toner image. Thus, a unit including the intermediate transfer belt 205 and the image forming apparatus are prevented from being increased in size in order to provide a mark outside the image forming area of the intermediate transfer belt 205, or cost is prevented from being increased in order to provide a dedicated optical sensor. There is also almost no difference in transferability between the overlapping portion 228 and the non-overlapping portion 229, and hence image formation can be performed without distinguishing the overlapping portion 228 and the non-overlapping portion 229. This avoids reduction in throughput at a time of printing. Details thereof are described below.

Figure 9:
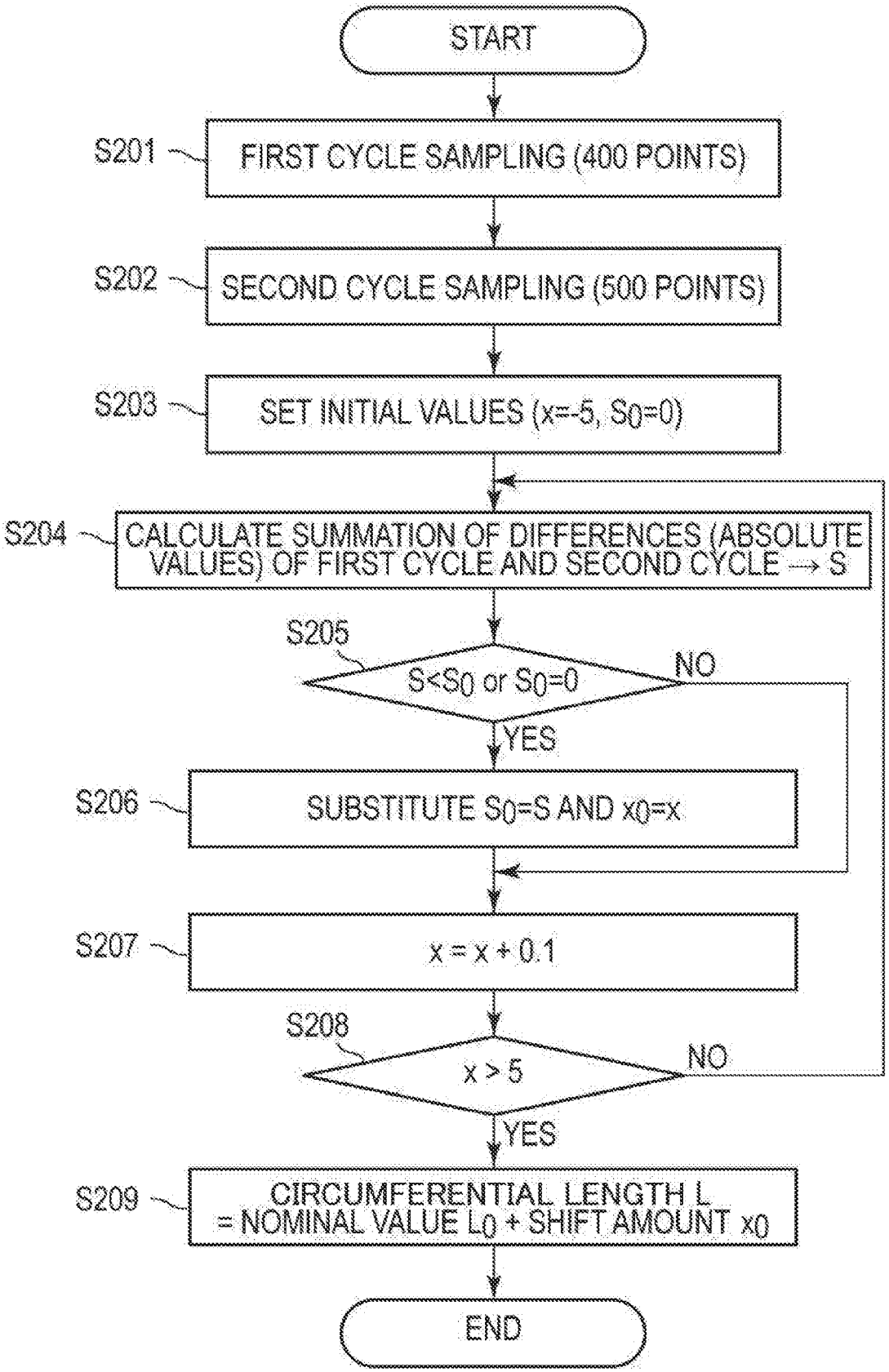
FIG. 9 is a flow chart for illustrating an outline of a procedure for circumferential length measurement in the first embodiment.

FIG. 9 is a flow chart for illustrating an outline of a flow of the circumferential length measurement to be executed in Step S105 of FIG. 8. In this case, as an example, a maximum fluctuation amount (maximum circumferential length fluctuation amount) of the actual circumferential length of the intermediate transfer belt 205 with respect to the nominal circumferential length (790 mm in the first embodiment) is set to ±5 mm, and an interval of sampling performed by the optical sensor 218 with respect to the circumferential direction of the intermediate transfer belt 205 is set to 0.1 mm.

First, the controller 201 (more specifically, circumferential length measurement portion 211*a*; the same applies to the following circumferential length measurement) acquires the regular reflection output (waveform data on the first cycle) of the optical sensor 218 in an area having a total of 400 points (40 mm) at intervals of 0.1 mm with respect to the surface of the intermediate transfer belt 205 (Step S201). In Step S104 of FIG. 8 at the previous stage, the timing adjustment is performed so as to match the timing at which the overlapping portion 228 reaches the detection position of the optical sensor 218, and hence the measurement is performed at the overlapping portion 228 in this case. At this time, it suffices that the waveform data on the first cycle is acquired for an area including at least a part of the overlapping portion 228, but it is preferred that the waveform data on the first cycle be acquired for an area including the entire overlapping portion 228. In the first embodiment, the width of the overlapping portion 228 with respect to the circumferential direction of the intermediate transfer belt 205 is about 20 mm, and a range for acquiring the waveform data on the first cycle is 40 mm. Thus, the waveform data on the first cycle is acquired for the area including the entire overlapping portion 228. Specifically, in Step S104 of FIG. 8, the timing adjustment is performed based on the nominal circumferential length (790 mm in the first embodiment) of the intermediate transfer belt 205 so that the acquisition of the waveform data on the first cycle can be started at a timing earlier by a predetermined time period before the overlapping portion 228 reaches the detection position of the optical sensor 218, even in consideration of the maximum circumferential length fluctuation amount of the intermediate transfer belt 205.

Subsequently, after about one cycle of the intermediate transfer belt 205, the controller 201 again acquires the regular reflection output (waveform data on the second cycle) of the optical sensor 218 at intervals of 0.1 mm with respect to the surface of the intermediate transfer belt 205 (Step S202). At this stage, the actual circumferential length of the intermediate transfer belt 205 is unknown. Thus, the regular reflection output of the optical sensor 218 is acquired for an area having a total of 500 points (50 mm), which is obtained by expanding 50 points (5 mm) corresponding to the assumed maximum circumferential length fluctuation amount before and after a position reached after a time period corresponding to the nominal circumferential length (790 mm in the first embodiment) the conveying direction of the intermediate transfer belt 205. In short, the waveform data (500 points) on the second cycle is acquired so as to cover the waveform data (400 points) on the first cycle. This aims to enable the actual circumferential length to be measured based on matching even when the circumferential length of the intermediate transfer belt 205 fluctuates within the range of ±5 mm being the maximum circumferential length fluctuation amount with respect to the nominal circumferential length due to the variations in parts and the environmental changes. That is, the waveform data on the first cycle can be shifted in the conveying direction of the intermediate transfer belt 205 before and after the same sampling range (position) as a sampling range (position) for the first cycle based on the nominal circumferential length of the intermediate transfer belt 205. In this case, the number of samples for the second cycle is caused to be larger than the number of samples for the first cycle by 100 points so that the waveform data can be shifted by 50 points (=5 mm) before and after in the conveying direction of the intermediate transfer belt 205. Thus, when the matching is executed 100 times while shifting by 1 point, it is possible to obtain the fluctuation of the circumferential length of the intermediate transfer belt 205 within the range of ±5 mm being the maximum circumferential length fluctuation amount.

Figure 10A:
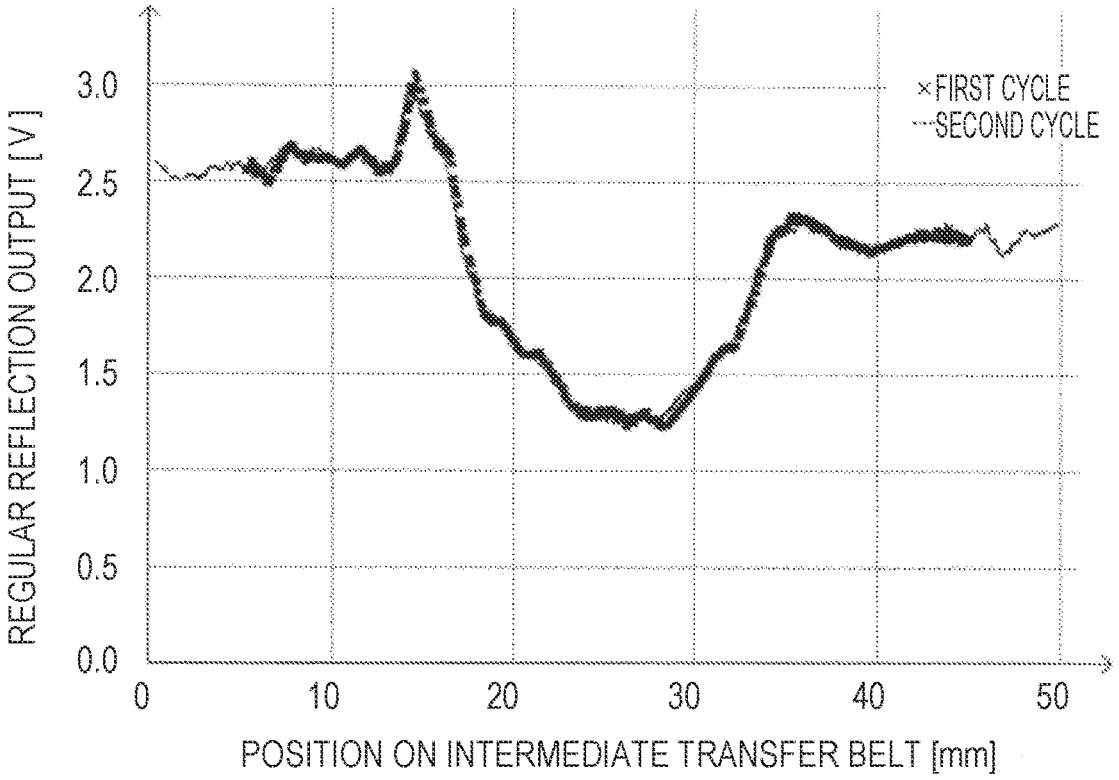
FIG. 10A is a graph for showing waveform data acquired in the circumferential length measurement in the first embodiment.

FIG. 10A shows an example of the waveform data on the first cycle and the waveform data on the second cycle each including the overlapping portion 228. On the horizontal axis, a measurement start point is set to 0 for the waveform data on the second cycle, and data earlier than the measurement start point for the second cycle by the nominal circumferential length is set to 0 for the waveform data on the first cycle. A substantially complete match between the waveform data on the first cycle and the waveform data on the second cycle means that the actual circumferential length of the intermediate transfer belt 205 is equal to the nominal circumferential length (790 mm in the first embodiment).

Subsequently, the controller 201 performs matching of both pieces of waveform data in order to determine a degree of overlap between the waveform data on the first cycle and the waveform data on the second cycle (Step S203 to Step S208). In the first embodiment, a summation S(x) of differences at a shift amount "x" is calculated by adding up absolute values of differences between the waveform data on the first cycle at a point "i" and the waveform data on the second cycle at a point i+x for the total of 400 points. In this case, the point i+x in the waveform data on the second cycle means a point shifted backward from the point "i" in the waveform data on the first cycle by the nominal circumferential length, and the shift amount "x" means a fluctuation amount from the point "i". Assuming that the regular reflection output at the point "i" in the waveform data on the first cycle is S1(*i*) and the regular reflection output at the point i+x in the waveform data on the second cycle is S2(*i*+x), the summation S(x) of differences with the shift amount "x" is expressed by Expression (1).

$$S(x) = \sum_{i=1}^{400} |S_1(i) - S_2(i+x)| \tag{1}$$

As described above, when the waveform data on the first cycle and the waveform data on the second cycle substantially completely match each other, the summation S(x) of differences becomes minimum. In view of this, a total of 100 summations S(x) of differences are calculated while keeping changing the shift amount "x" by 1 point (0.1 mm), to thereby calculate a minimum value S0 of a summation of differences having a minimum value in the total of 100 summations S(x) of differences and a shift amount x0 obtained at that time. When the shift amount "x" at the time at which the summation S of differences has the minimum value is obtained, it is possible to obtain a deviation (expansion/contraction) from a reference set as the nominal circumferential length of the intermediate transfer belt 205.

More specifically, in the first embodiment, the following processing is performed. In FIG. 9, for the sake of convenience, the shift amount "x" is shown as a value converted into a length (mm). First, the controller 201 sets an initial value of the shift amount "x" to −5 mm (−50 points), an initial value of the minimum value S0 of the summation of differences to 0, and the shift amount x0 at the time of the minimum summation S of differences to the initial value of the shift amount "x", and stores the settings in the RAM 213 (Step S203). Subsequently, the controller 201 calculates the summation S of differences with the currently-set shift amount "x" (Step S204). Subsequently, the controller 201 determines whether or not the currently-calculated summation S of differences is smaller than the currently-stored minimum value S0 of the summation of differences (or the summation of differences is 0) (Step S205). When the determination of Step S205 results in "YES", the controller 201 updates the minimum value S0 of the summation of differences to the currently-calculated summation S of differences, and updates the shift amount x0 at the time of the minimum summation S of differences to the currently-set shift amount "x", and stores the settings in the RAM 213 (Step S206). When the determination of Step S205 results in "NO", the controller 201 advances to the processing of Step S207 without updating the minimum value S0 of the summation of differences and the shift amount x0 at the time of the minimum summation S of differences. Subsequently, the controller 201 increases the shift amount "x" by 0.1 mm (1 point) (Step S207), and repeats the processing of from Step S204 to Step S207 until the shift amount becomes +5 mm (+50 points) (Step S208).

After that, the controller 201 adds a length corresponding to the shift amount x0 at the time of the minimum summation S of differences, which has been obtained as described above, to a nominal circumferential length L0 of the intermediate transfer belt 205 to calculate an actual circumferential length L of the intermediate transfer belt 205, and stores the actual circumferential length L in the nonvolatile memory 214 (Step S209).

Figure 10B:
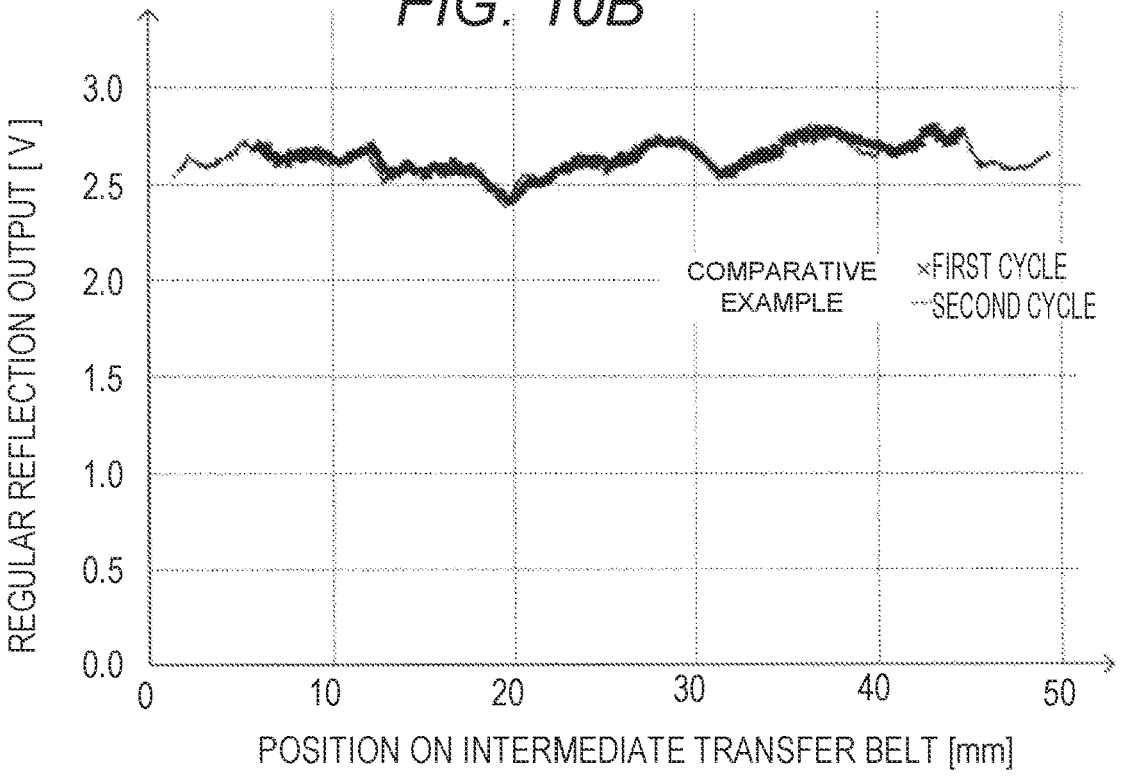
FIG. 10B is a graph for showing waveform data acquired in circumferential length measurement in Comparative Example.

Now, FIG. 10B shows, as Comparative Example, a result of acquiring the waveform data on the first cycle and the waveform data on the second cycle at a given position in the non-overlapping portion 229 without performing the timing adjustment in Step S104 of FIG. 8. It is to be understood that the waveform data acquired for the overlapping portion 228 in the first embodiment shown in FIG. 10A exhibits a change steeper than that of the waveform data acquired for the non-overlapping portion 229 in Comparative Example shown in FIG. 10B. In the following description, the summations S(x) of differences are calculated based on both the waveform data in the first embodiment shown in FIG. 10A and the waveform data in Comparative Example shown in FIG. 10B, and compared with each other, to thereby show that the measurement accuracy of the circumferential length of the intermediate transfer belt 205 is improved in the first embodiment.

Figure 11A:
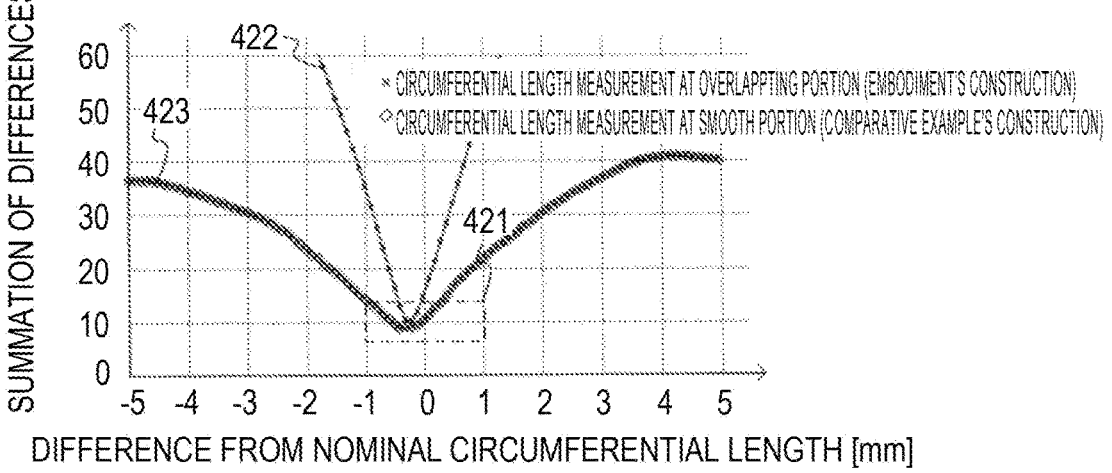
FIG. 11A is a graph for showing an error in the circumferential length measurement in the first embodiment and Comparative Example.

FIG. 11A shows a change 422 of the summation S(x) of differences based on the waveform data in the first embodiment shown in FIG. 10A and a change 423 of the summation S(x) of differences based on the waveform data in Comparative Example shown in FIG. 10B. The horizontal axis represents a difference from the nominal circumferential length, which is obtained by converting the shift amount "x" into a length. As described above, it can be confirmed that the summation S(x) of differences has a minimum value at a certain shift amount x0.

Figure 11B:
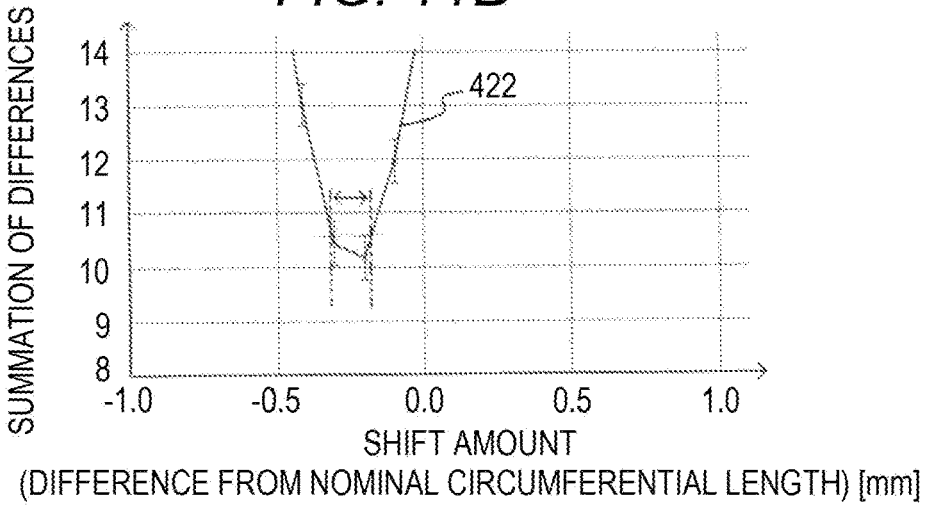
FIG. 11B is an enlarged graph for showing an area 421 shown in FIG. 11A, which relates to a summation 422 of differences in the first embodiment.

FIG. 11B is an enlarged graph for showing an area 421 shown in FIG. 11A, which relates to the summation 422 of differences in the first embodiment. In the first embodiment's configuration, the measurement error in the optical sensor 218 is about 20 mV and hence a root-mean-square value σ of the summation S(x) of differences is σ=0.4. This root-mean-square value σ is shown as an error bar. The summation 422 of differences in the first embodiment is minimum at the shift amount of −0.2 mm, and hence the measurement result of the circumferential length of the intermediate transfer belt 205 is 789.8 mm (=790 mm−0.2 mm). In addition, in consideration of the error bar, the measurement error in the circumferential length of the intermediate transfer belt 205 in the first embodiment is 0.1 mm (between −0.3 mm and −0.2 mm).

Figure 11C:
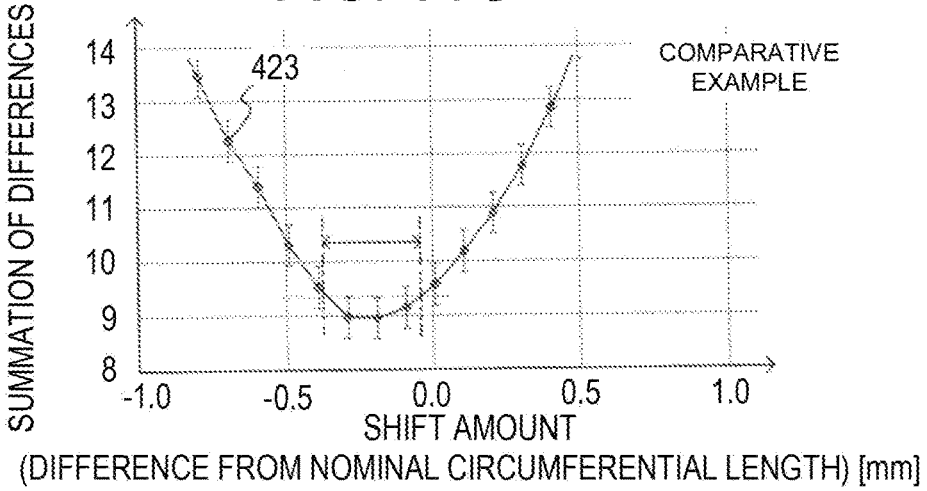
FIG. 11C is an enlarged graph for showing the area 421 shown in FIG. 11A, which relates to a summation 423 of differences in Comparative Example.

Meanwhile, FIG. 11C is an enlarged graph for showing the area 421 shown in FIG. 11.A, which relates to the summation 423 of differences in Comparative Example. The summation 423 of differences in Comparative Example is minimum at the shift amount of −0.2 mm, and hence the measurement result of the circumferential length of the intermediate transfer belt 205 is 789.8 mm (=790 mm-0.2 mm), which is the same value as in the first embodiment. However, the measurement error in the circumferential length of the intermediate transfer belt 205 in Comparative Example is 0.4 mm (between −0.4 mm and 0.0 mm). Thus, it is to be understood that the accuracy is higher in the first embodiment described above than in Comparative Example.

The output of the optical sensor 218 changes depending on the position on the intermediate transfer belt 205, and may change even by 0.1 V when the position changes by 0.5 mm. Meanwhile, when the difference in the position on the intermediate transfer belt 205 falls within 0.1 mm, the change in the output of the optical sensor 218 falls within 0.02 V. Of the background outputs 404 at the five points and the patch outputs 405 at the five points, which are shown in FIG. 5B, a background output 425 and a patch output 426 are used to describe how much influence is exerted by the fluctuation of the above-mentioned background output. The background output 425 is 2.45 V the patch output 426 is 1.10 V, and the standardized output is calculated as 0.449 V from those outputs. When the background output 425 fluctuates by ±0.02 V, the standardized output fluctuates from 0.445 V to 0.453 V. A difference from a standardized output of 0.449 V obtained from the above-mentioned background output 425 and patch output 426 is from −0.004 V to 0.004 V. As described above, the standard deviation of the standardized outputs 406 at the five points is 0.005, and hence the values of those differences fall within the standard deviation of the standardized output 406. Meanwhile, when the background output 425 fluctuates by ±0.10 V, the standardized output fluctuates from 0.431 V to 0.468 V. A difference from the standardized output of 0.449 V obtained from the above-mentioned background output 425 and patch output 426 is from −0.018 to 0.019 V in this case, the values of those differences are larger than the standard deviation of the standardized output 406.

As described above, in the first embodiment, the regular reflection output locally changes at the overlapping portion 228, and hence the waveform data for the overlapping portion 228 is used to calculate the summation S(x) of differences. In this manner, the fluctuation of the summation S(x) of differences becomes larger when the summation S(x) of differences is calculated based on the waveform data for the overlapping portion 228 than when the summation S(x) of differences is calculated based on the waveform data for the non-overlapping portion 229. Thus, the measurement accuracy of the circumferential length of the intermediate transfer belt 205 becomes higher.

The circumferential length measurement for the intermediate transfer belt 205 may be performed in synchronization with the image density control as in the first embodiment, or may be performed alone separately from the image density control. The circumferential length measurement for the intermediate transfer belt 205 can be executed at any timing during the image non-formation time, for example, the pre-multi rotation step and the pre-rotation step. Examples of this timing include timings at which: an elapsed time since the previous circumferential length measurement or the number of sheets subjected to the image formation has become equal to or larger than a predetermined value; an environmental parameter has fluctuated after the time of the previous circumferential length measurement by a value equal to or larger than a predetermined value; an idle time period after the last job has become equal to or larger than a predetermined time period; and the intermediate transfer belt 205 or other replacement part has been replaced. In the first embodiment, it is assumed that when the number of sheets subjected to the image formation has become equal to or larger than the predetermined value after the time of the previous circumferential length measurement, the circumferential length measurement for the intermediate transfer belt 205 is performed in the pre-rotation step of the next job or the pre-multi rotation step before the next job is started. Although not shown in FIG. 8, in the first embodiment, the circumferential length measurement portion 211*a* determines whether or not a timing to perform the circumferential length measurement for the intermediate transfer belt 205 has been reached. When the circumferential length measurement is not performed in the image density control, the image density control may be performed through use of a result of the circumferential length measurement that was performed earlier (typically, performed last). A timing to execute the image density control can also be set at any timing from the same viewpoint as described above.

5-3. Measurement Positions for Background Output and Patch Output

Figure 12:
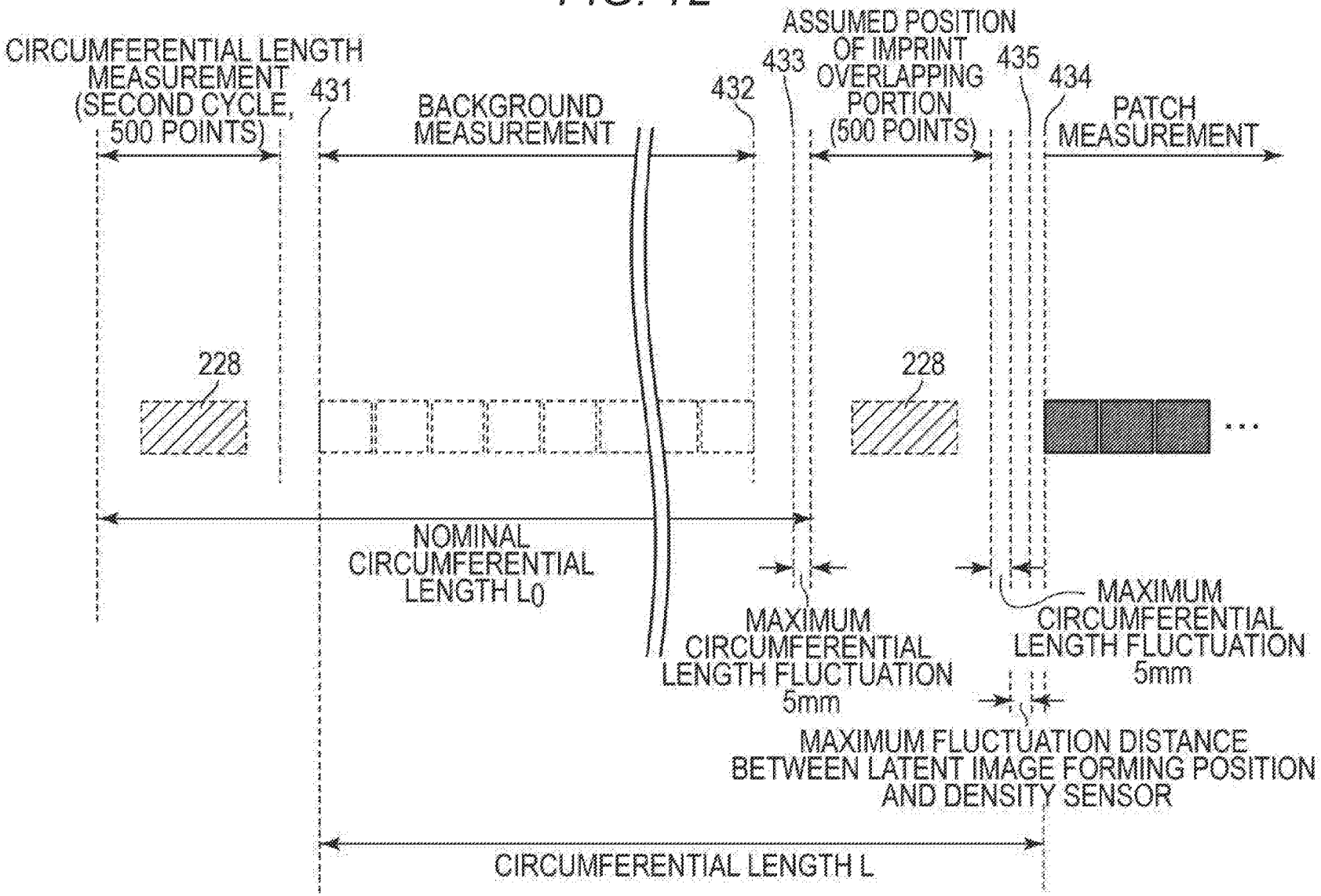
FIG. 12 is a schematic view for illustrating timings of background measurement and patch measurement in the first embodiment.

FIG. 12 is a schematic view for illustrating, as positions in the circumferential direction on the intermediate transfer belt 205, a flow from acquisition of the waveform data on the second cycle in the circumferential length measurement (Step S202 of FIG. 9) to measurement of the test toner image (Step S108 of FIG. 8). The flow is arranged in chronological order from the left side to the right side shown in FIG. 12, and the acquisition of the waveform data on the second cycle in the circumferential length measurement is illustrated on the leftmost side. With reference to FIG. 12, a position at which background output measurement (hereinafter also referred to as "background measurement") is performed in the image density control and a position at which patch output measurement (hereinafter also referred to as "patch measurement") is performed are further described.

In the first embodiment, the background measurement (Step S106 of FIG. 8) is started at a timing 431 after a predetermined time period has elapsed since the acquisition of the waveform data on the second cycle in the circumferential length measurement was completed (acquisition at the 500th point was completed). As described above, in the first embodiment, the waveform data on the second cycle is acquired for an area larger than the overlapping portion 228 so that the overlapping portion 228 is included even in consideration of +5 mm being the maximum circumferential length fluctuation amount of the intermediate transfer belt 205. That is, the above-mentioned predetermined time period is set in advance so that the background measurement start timing 431 does not overlap a period during which the overlapping portion 228 is passing through the detection position of the optical sensor 218 even in consideration of +5 mm being the maximum circumferential length fluctuation amount of the intermediate transfer belt 205. More specifically, in the first embodiment, the background measurement start timing 431 is set so as to fall after an end timing of the acquisition of the waveform data on the second cycle (corresponding to 500 points) set for the overlapping portion 228, even in consideration of +5 mm being the maximum circumferential length fluctuation amount of the intermediate transfer belt 205. Thus, the background measurement start timing 431 does not overlap the period during which the overlapping portion 228 is passing through the detection position of the optical sensor 218.

In addition, in the first embodiment, the background measurement is brought to an end at a timing 432 earlier by a predetermined time period before the overlapping portion 228 reaches the detection position of the optical sensor 218 again after about one cycle of the intermediate transfer belt 205. This predetermined time period is set in advance so that the background measurement end timing 432 does not overlap the period during which the overlapping portion 228 is passing through the detection position of the optical sensor 218 even in consideration of ±5 mm being the maximum circumferential length fluctuation amount of the intermediate transfer belt 205. More specifically, in the first embodiment, the background measurement end timing 432 is set so as to fall before a start timing 433 of the acquisition of the waveform data on the second cycle (corresponding to 500 points) set for the overlapping portion 228, even in consideration of ±5 mm being the maximum circumferential length fluctuation amount of the intermediate transfer belt 205. Thus, the background measurement end timing 432 does not overlap the period during which the overlapping portion 228 is passing through the detection position of the optical sensor 218.

Subsequently, in order to determine whether or not a patch measurement start timing 434 overlaps the overlapping portion 228, it is desired to consider a shift in the image formation together with the timing at which the overlapping portion 228 reaches the detection position of the optical sensor 218. Specifically, it is desired to consider a shift from the nominal circumferential length between a latent image forming position (exposure position) and the primary transfer portion N1 and a shift from the nominal circumferential length between the primary transfer portion N1 and the detection position of the optical sensor 218. The shift between the primary transfer portion N1 and the detection position of the optical sensor 218 is included in the shift in the circumferential length of the intermediate transfer belt 205, but cannot be separated. Thus, in the first embodiment, a shift amount obtained by adding the shift between the latent image forming position and the detection position of the optical sensor 218 to the shift in the circumferential length of the intermediate transfer belt 205 is taken into consideration. In short, in the first embodiment, the patch measurement is started at a timing being a predetermined time period after the overlapping portion 228 has finished passing through the detection position of the optical sensor 218. This predetermined time period is set in advance so that the patch measurement start timing 434 does not overlap the period during which the overlapping portion 228 is passing through the detection position of the optical sensor 218 even in consideration of the shifts added in the above-mentioned manner. More specifically, in the first embodiment, the patch measurement start timing 434 is set so as to fall after an end timing 435 of the acquisition of the waveform data on the second cycle (corresponding to 500 points) set for the overlapping portion 228, even in consideration of the shifts added in the above-mentioned manner. Thus, the patch measurement start timing 434 does not overlap the period during which the overlapping portion 228 is passing through the detection position of the optical sensor 218.

In the first embodiment, the lengths of the areas for performing the background measurement and the patch measurement with respect to the circumferential direction of the intermediate transfer belt 205 are sufficiently shorter than the length of the area from a trailing edge of the overlapping portion 228 to a leading edge of the overlapping portion 228 for the next cycle (about one cycle of the intermediate transfer belt 205).

As described above, in the first embodiment, the circumferential length measurement for the intermediate transfer belt 205 is performed at the overlapping portion 228 at which the output of the optical sensor 218 locally changes. Thus, it is possible to perform the circumferential length measurement for the intermediate transfer belt 205 with high accuracy, and as a result, it is possible to perform the image density control with high accuracy. In addition, in the first embodiment, the test toner image for the image density control is formed so as to avoid the overlapping portion 228. Thus, the image density control can be performed with higher accuracy. Further, in the first embodiment, an image can be formed without distinguishing the overlapping portion 228 and the non-overlapping portion 229, and hence it is possible to suppress the reduction in throughput at the time of printing.

Second Embodiment

Next, another embodiment of the present disclosure is described. A basic configuration and a basic operation of an image forming apparatus according to a second embodiment are the same as those of the image forming apparatus according to the first embodiment. Thus, in the image forming apparatus according to the second embodiment, components having the same or corresponding functions or configurations as those of the image forming apparatus according to the first embodiment are denoted by the same reference symbols as those in the first embodiment, and detailed description thereof is omitted.

In the first embodiment, the overlapping portion 228 being an area having an optical peculiarity of the intermediate transfer belt 205 is used to acquire the information relating to the circumferential length of the intermediate transfer belt 205 as the information relating to the position in the circumferential direction on the intermediate transfer belt 205. Further, in the first embodiment, this information relating to the circumferential length of the intermediate transfer belt 205 is used to perform the control for the timing to acquire the output (background output and patch output) of the optical sensor 218 in the image density control as the control (phase control) relating to the position in the circumferential direction on the intermediate transfer belt 205. Meanwhile, in the second embodiment, the overlapping portion 228 of the intermediate transfer belt 205 is used to acquire (set) the information relating to the reference position with respect to the circumferential direction of the intermediate transfer belt 205 as the information relating to the position in the circumferential direction on the intermediate transfer belt 205. Then, in the second embodiment, in the same manner as in the first embodiment, this information relating to the reference position is used to perform the control for the timing to acquire the output (background output and patch output) of the optical sensor 218 in the image density control as the control (phase control) relating to the position in the circumferential direction on the intermediate transfer belt 205. In short, in the second embodiment, the timing of the background measurement and the timing of the patch measurement are adjusted based on the overlapping portion 228 of the intermediate transfer belt 205.

In the second embodiment, in order to determine the position of the overlapping portion 228, the regular reflection output of the optical sensor 218 is measured while rotating the intermediate transfer belt 205. This measurement can be started from a freely-set position in the circumferential direction of the intermediate transfer belt 205, and the position of the overlapping portion 228 can be detected at least once while the intermediate transfer belt 205 is rotated by about one cycle. When the detection of the position of the overlapping portion 228 is completed before the intermediate transfer belt 205 has been rotated by one cycle, the subsequent processing, for example, the background measurement may be started before the intermediate transfer belt 205 has been rotated by one cycle.

Figure 13:
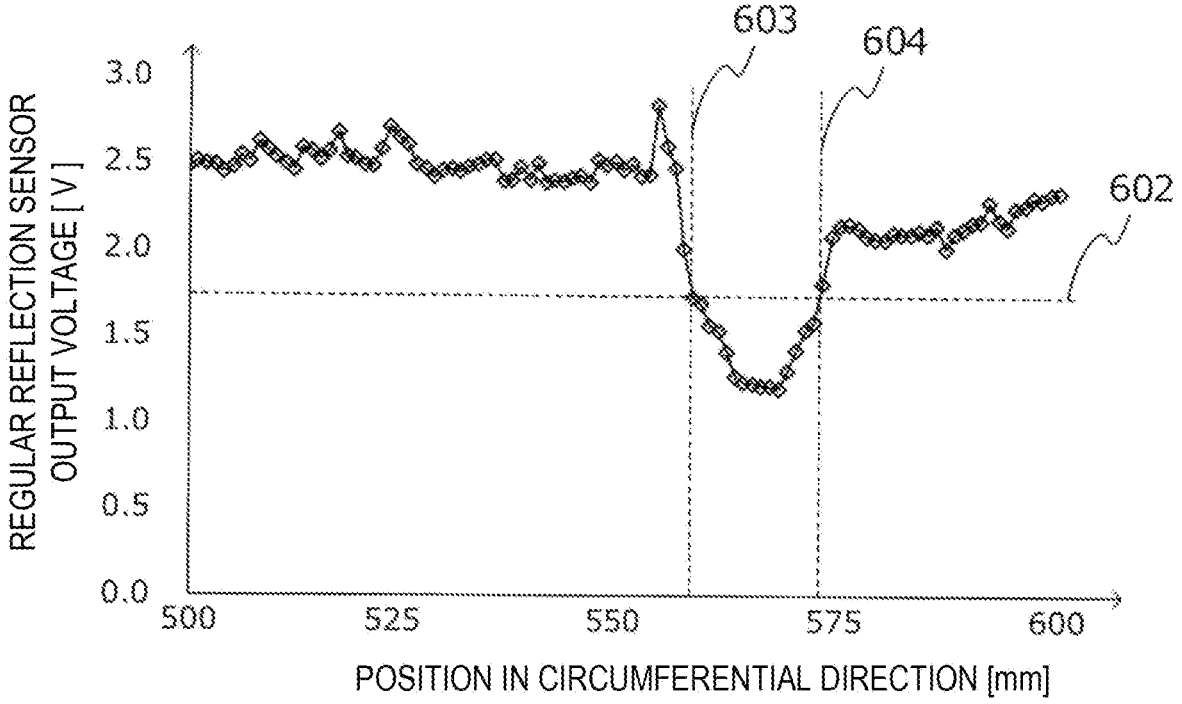
FIG. 13 is a graph for showing a method of detecting a reference position on the intermediate transfer belt in a second embodiment.

FIG. 13 is a graph for showing an example of the regular reflection output of the optical sensor 218 in the vicinity of the overlapping portion 228. The regular reflection output is locally lowered at the overlapping portion 228. In the second embodiment, an overlapping portion determination value 602 is set as a reference value. In the second embodiment, a timing at which the regular reflection output falls below the overlapping portion determination value 602 in accordance with the rotation of the intermediate transfer belt 205 is determined to be an overlapping portion leading edge timing 603. The overlapping portion leading edge timing 603 corresponds to a timing at which a leading edge position of the overlapping portion 228 in the conveying direction of the intermediate transfer belt 205 passes through the detection position of the optical sensor 218. In addition, in the second embodiment, a timing at which the regular reflection output exceeds the overlapping portion determination value 602 in accordance with the further rotation of the intermediate transfer belt 205 is determined to be an overlapping portion trailing edge timing 604. The overlapping portion trailing edge timing 604 corresponds to a timing at which a trailing edge position of the overlapping portion 228 in the conveying direction of the intermediate transfer belt 205 passes through the detection position of the optical sensor 218. In the second embodiment, a fixed value of 1.7 V is set as the overlapping portion determination value 602. However, the overlapping portion determination value 602 is not limited thereto. The regular reflection output may fluctuate due to the abrasion of the surface layer of the intermediate transfer belt 205. Thus, for example, it is also possible to dynamically set the overlapping portion determination value 602 by calculating the overlapping portion determination value 602 based on an average value of the regular reflection output in a predetermined range (corresponding to, typically, about one cycle of the intermediate transfer belt 205) with respect to the circumferential direction of the intermediate transfer belt 205. For example, a difference from the average value may be set in advance, and a value obtained by subtracting this difference from the average value can be used as the overlapping portion determination value 602. In addition, the overlapping portion determination value 602 may be changed based on an index value (for example, number of revolutions or rotation time period) correlating with a usage amount of the intermediate transfer belt 205.

Figure 19B:
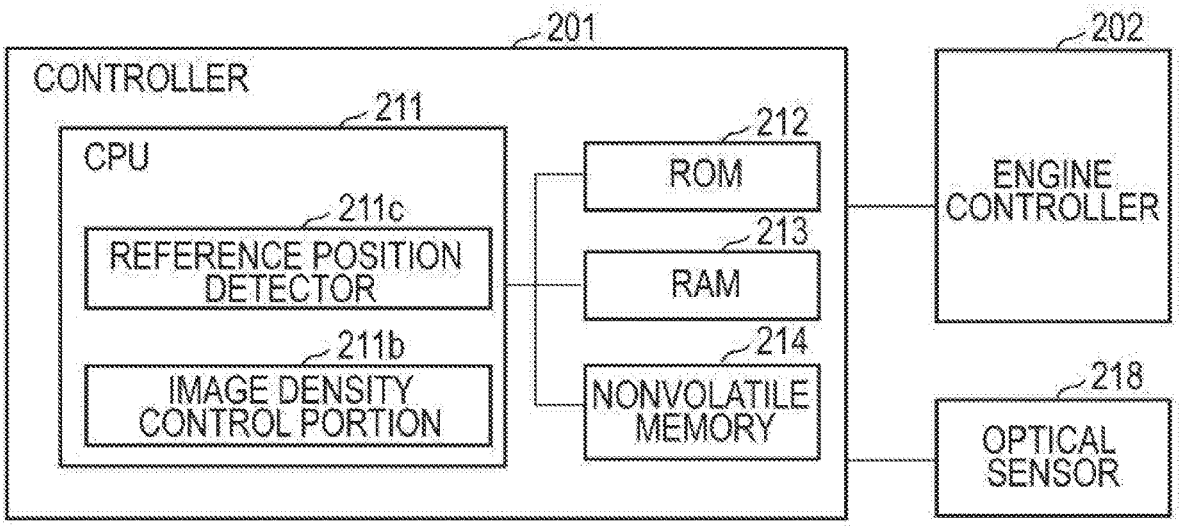
FIG. 19B is a schematic block diagram for illustrating an example of a control mode for a main part of the image forming apparatus according to the second embodiment.

FIG. 19B is a schematic block diagram for illustrating a control mode for a main part of an image forming apparatus 200 according to the second embodiment. The control mode in the second embodiment is the same as the control mode in the first embodiment illustrated in FIG. 19A. However, in the second embodiment, the CPU 211 includes, as its feature function, a reference position detector 211*c* in place of the circumferential length measurement portion 211*a* in the first embodiment. The CPU 211 loads the control program stored in the ROM 212 into the RAM 213 to execute processing, to thereby be able to achieve a function of the reference position detector 211*c*. As described later, the reference position detector 211*c* is configured to detect the reference position with respect to the circumferential direction of the intermediate transfer belt 205 based on the data acquired from the intermediate transfer belt 205 by the optical sensor 218.

Figure 14:
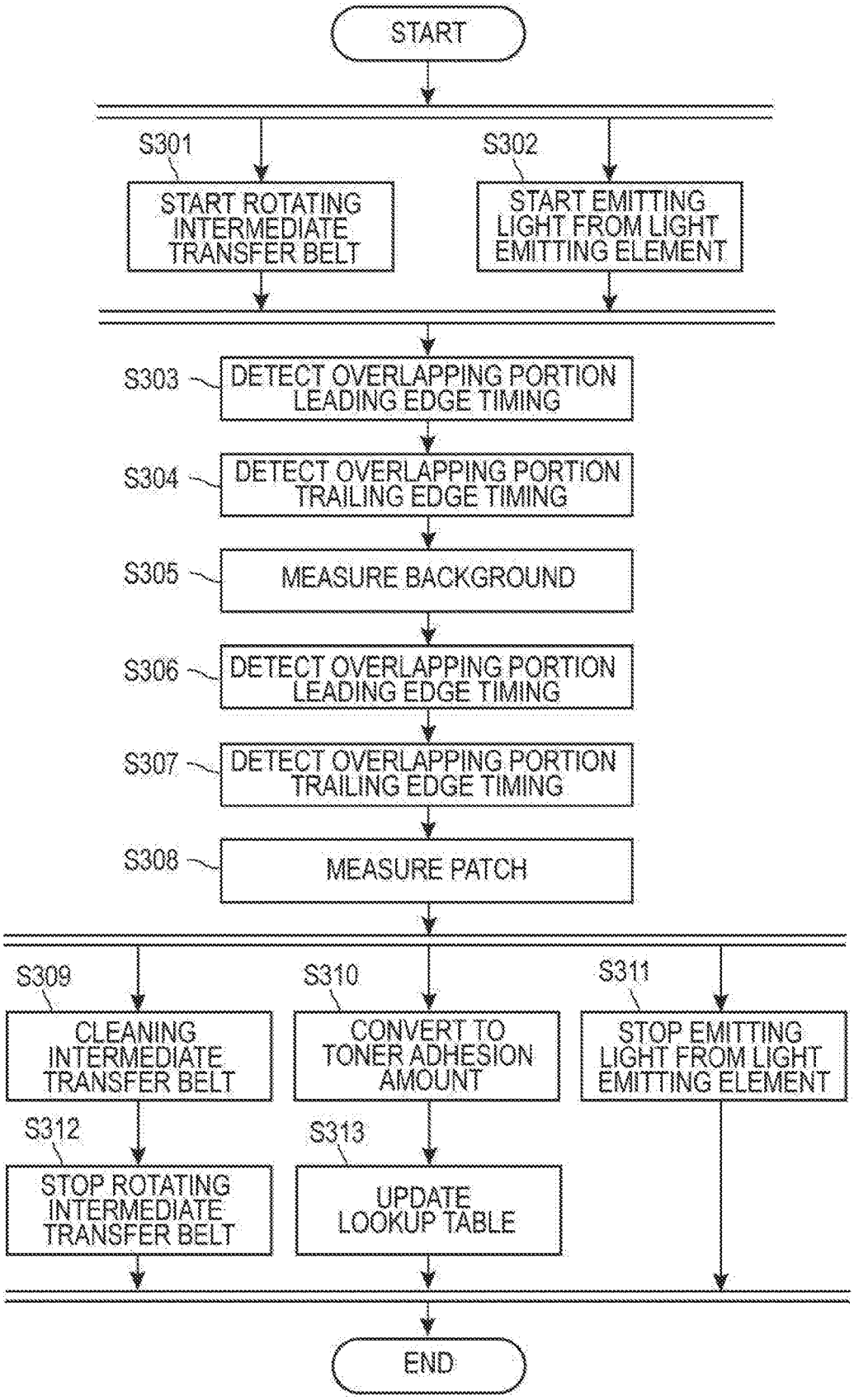
FIG. 14 is a flow chart for illustrating an outline of a procedure for image density control in the second embodiment.

FIG. 14 is a flow chart for illustrating an outline of a flow of the image density control in the second embodiment. First, the controller 201 controls the intermediate transfer belt 205 to start its rotation (Step S301), and in parallel with this, controls the light emitting element 219 of the optical sensor 218 to emit light (Step S302). Subsequently, the controller 201 monitors the regular reflection output of the optical sensor 218 while rotating the intermediate transfer belt 205, and repeatedly determines whether or not the regular reflection output falls below the overlapping portion determination value 602 as described above, to thereby detect the overlapping portion leading edge timing 603 (Step S303). Subsequently, the controller 201 further monitors the regular reflection output of the optical sensor 218 while rotating the intermediate transfer belt 205, and repeatedly determines whether or not the regular reflection output exceeds the overlapping portion determination value 602 as described above, to thereby detect the overlapping portion trailing edge timing 604 (Step S304). Then, the controller 201 acquires the background output from the optical sensor 218 at the timing that does not overlap the overlapping portion 228 based on at least one of the overlapping portion leading edge timing 603 or the overlapping portion trailing edge timing 604, which has been detected immediately before (Step S305). After about one cycle of the intermediate transfer belt 205, the controller 201 again detects the overlapping portion leading edge timing 603 and the overlapping portion trailing edge timing 604 in the same manner as described above (Step S306 and Step S307). Then, the controller 201 acquires the patch output from the optical sensor 218 at the timing that does not overlap the overlapping portion 228 based on at least one of the overlapping portion leading edge timing 603 or the overlapping portion trailing edge timing 604, which has been detected immediately before (Step S308). After that, the processing of from Step S309 to Step S313 shown in FIG. 14 is the same as the processing of from Step S109 to Step S113 shown in FIG. 8, respectively, and hence description thereof is omitted.

Figure 15:
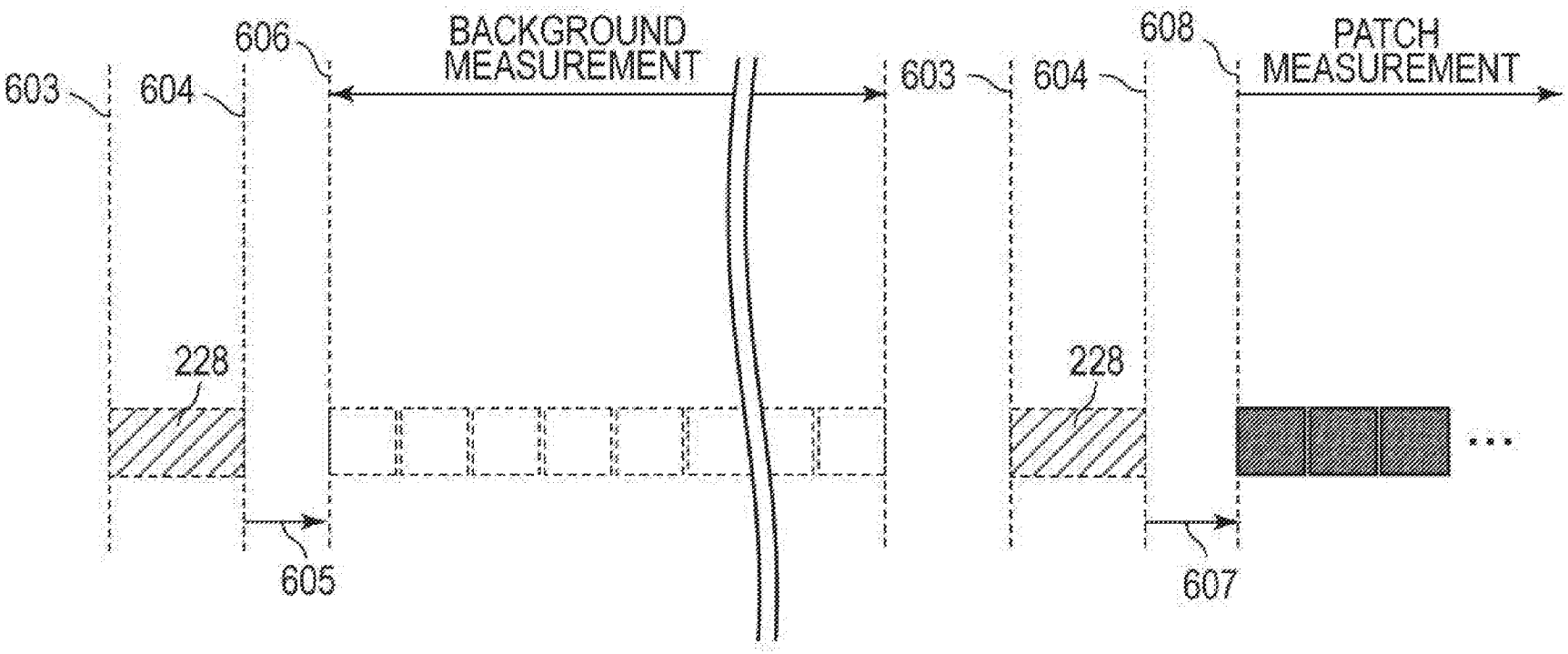
FIG. 15 is a schematic view for illustrating timings of background measurement and patch measurement in the second embodiment.

FIG. 15 is a schematic view for illustrating, as positions in the circumferential direction on the intermediate transfer belt 205, the setting of the timings of the background measurement and the patch measurement in the second embodiment. The timings are arranged in chronological order from the left side to the right side shown in FIG. 14. In the second embodiment, in order to prevent the overlapping portion trailing edge timing 604 and a background measurement start timing 606 from overlapping each other, the background measurement start timing 606 is set after a predetermined time period 605 from the overlapping portion trailing edge timing 604 detected immediately before. This predetermined time period is set in advance so that the background measurement start timing 606 does not overlap the period during which the overlapping portion 228 is passing through the detection position of the optical sensor 218 even in consideration of the maximum circumferential length fluctuation amount (for example, +5 mm) of the intermediate transfer belt 205. In addition, in the second embodiment, in order to prevent the overlapping portion trailing edge timing 604 and a patch measurement start timing 608 from overlapping each other, the patch measurement start timing 608 is set after a predetermined time period 607 from the overlapping portion trailing edge timing 604 detected immediately before. A measurement position for the background output and a measurement position for the patch output with respect to the circumferential direction of the intermediate transfer belt 205 can set as the same position by setting the predetermined time period 607 at the start of the patch measurement and the predetermined time period 605 at the start of the background measurement, which are described above, as the same period.

In the same manner as in the first embodiment, in the second embodiment, the lengths of the areas for performing the background measurement and the patch measurement with respect to the circumferential direction of the intermediate transfer belt 205 are sufficiently shorter than the length of the area from the trailing edge of the overlapping portion 228 to the leading edge of the overlapping portion 228 for the next cycle (about one cycle of the intermediate transfer belt 205).

In the second embodiment, it is described that both the overlapping portion leading edge timing and the overlapping portion trailing edge timing are detected, but in a case of using only one of the timings as a reference, only the one to be used may be detected. In another case, for example, an intermediate timing obtained from the overlapping portion leading edge timing and the overlapping portion trailing edge timing may be used as a reference.

As described above, in the second embodiment, the overlapping portion 228 on the intermediate transfer belt 205 is used as the reference position, to thereby set the measurement timing of the background output and the measurement timing of the patch output. Thus, the measurement position of the background output and the measurement position of the patch output with respect to the circumferential direction of the intermediate transfer belt 205 can be set as the same position with high accuracy. Thus, according to the second embodiment, the same effects as those of the first embodiment can be produced, and the control can be simplified as compared with the first embodiment.

Third Embodiment

Next, another embodiment of the present disclosure is described. A basic configuration and a basic operation of an image forming apparatus according to a third embodiment are the same as those of the image forming apparatus according to the first embodiment. Thus, in the image forming apparatus according to the third embodiment, components having the same or corresponding functions or configurations as those of the image forming apparatus according to the first embodiment are denoted by the same reference symbols as those in the first embodiment, and detailed description thereof is omitted.

In the third embodiment, as the area having an optical peculiarity, the intermediate transfer belt 205 has an area subjected to a smaller number of times of imprint processing than in another area, in a part thereof in its circumferential direction. In particular, in the third embodiment, as the area having an optical peculiarity, the intermediate transfer belt 205 has an area that is not subjected to the imprint processing in a part thereof in its circumferential direction. Then, in the third embodiment, this area that is not subjected to the imprint processing is used to measure the circumferential length of the intermediate transfer belt 205 in the same manner as in the first embodiment.

Figure 16:
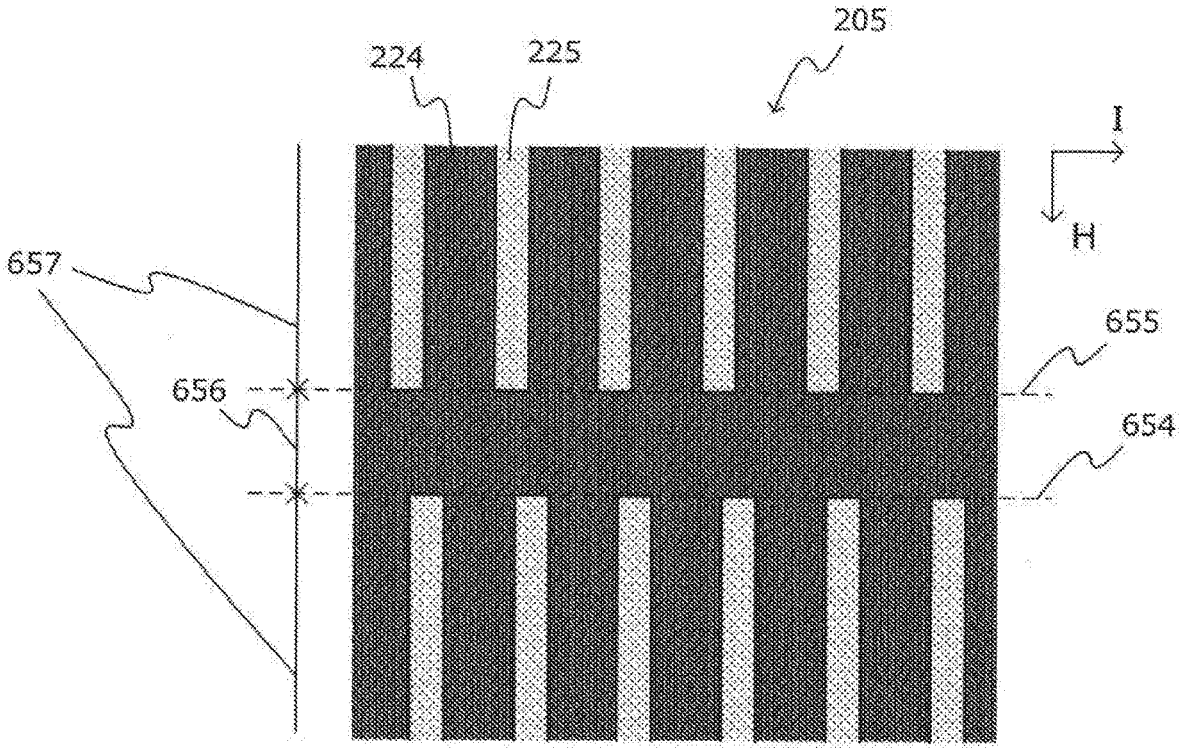
FIG. 16 is a schematic view for illustrating the surface of the intermediate transfer belt in the vicinity of end portions of imprint processing in a third embodiment.

FIG. 16 is an enlarged schematic view of a part of the surface (outer peripheral surface) of the intermediate transfer belt 205 in the third embodiment. In the same manner as in the first embodiment, the imprint processing is performed by rotating the intermediate transfer belt 205 while pressing the mold G against the intermediate transfer belt 205. Thus, in the same manner as in the first embodiment, the surface of the intermediate transfer belt 205 subjected to the imprint processing has the protruding portions 224 and the recessed portions 225, which are substantially uniform (substantially parallel) with respect to the circumferential direction H and periodic with respect to the width direction I. The imprint processing is performed along the circumferential direction H from an imprint processing start position 654 up to an imprint processing end position 655. In this case, in the third embodiment, the imprint processing end position 655 does not match the imprint processing start position 654, and is arranged at a position that is not beyond the imprint processing start position 654. Thus, in the third embodiment, an imprint non-processed portion (hereinafter also referred to simply as "non-processed portion") 656 serving as the area having an optical peculiarity, which is an area that is not subjected to the imprint processing, is formed on the intermediate transfer belt 205 in a part thereof in its circumferential direction. An area other than the non-processed portion 656 with respect to the circumferential direction of the intermediate transfer belt 205, that is, the area subjected to the imprint processing, is set as an imprint processed portion (hereinafter also referred to simply as "processed portion") 657.

From the viewpoint of the abrasion resistance of the belt cleaning blade 216, the processed portion 657 (first areal is desired to be as long as possible. Meanwhile, in order to cause the non-processed portion 656 (second area) to be present even when the imprint processing end position 655 slightly fluctuates, it is desired to bring the imprint processing to an end at a position a predetermined distance before the imprint processing start position 654. In the third embodiment, the nominal circumferential length of the intermediate transfer belt 205 is 790 mm. In addition, in the third embodiment, the length of the non-processed portion 656 with respect to the circumferential direction of the intermediate transfer belt 205 is about 20 mm. The length of the non-processed portion 656 is not limited thereto, and from the above-mentioned viewpoint, is preferred to be about 5 mm or more and about 50 mm or less, and further preferred to be about 10 mm or more and 30 mm or less.

In the non-processed portion 656, the amount of reflection light reflected in the regular reflection direction when the intermediate transfer belt 205 is irradiated with light becomes larger than in the processed portion 657. However, the depth of each recessed portion 225 in the processed portion 657 is considerably smaller than the thickness of the intermediate transfer belt 205, and hence there is almost no difference in transferability between the non-processed portion 656 and the processed portion 657. In short, a normal image to be output by a job can be formed in the same manner in both the non-processed portion 656 and the processed portion 657.

In the third embodiment, the increase in the amount of reflection light in the non-processed portion 656 is used to calculate the circumferential length of the intermediate transfer belt 205.

In the third embodiment, the imprint processing is performed by less than one cycle of the intermediate transfer belt 205 to cause the non-processed portion 656 to be present. However, the imprint processing may be performed by two cycles or more to cause the area being subjected to a smaller number of times of imprint processing than in another area and having an optical peculiarity to be present. Even in this case, it is possible to calculate the circumferential length of the intermediate transfer belt 205 in the same manner as in the third embodiment (or detect the reference position in the same manner as in a fourth embodiment described later).

Figure 17:
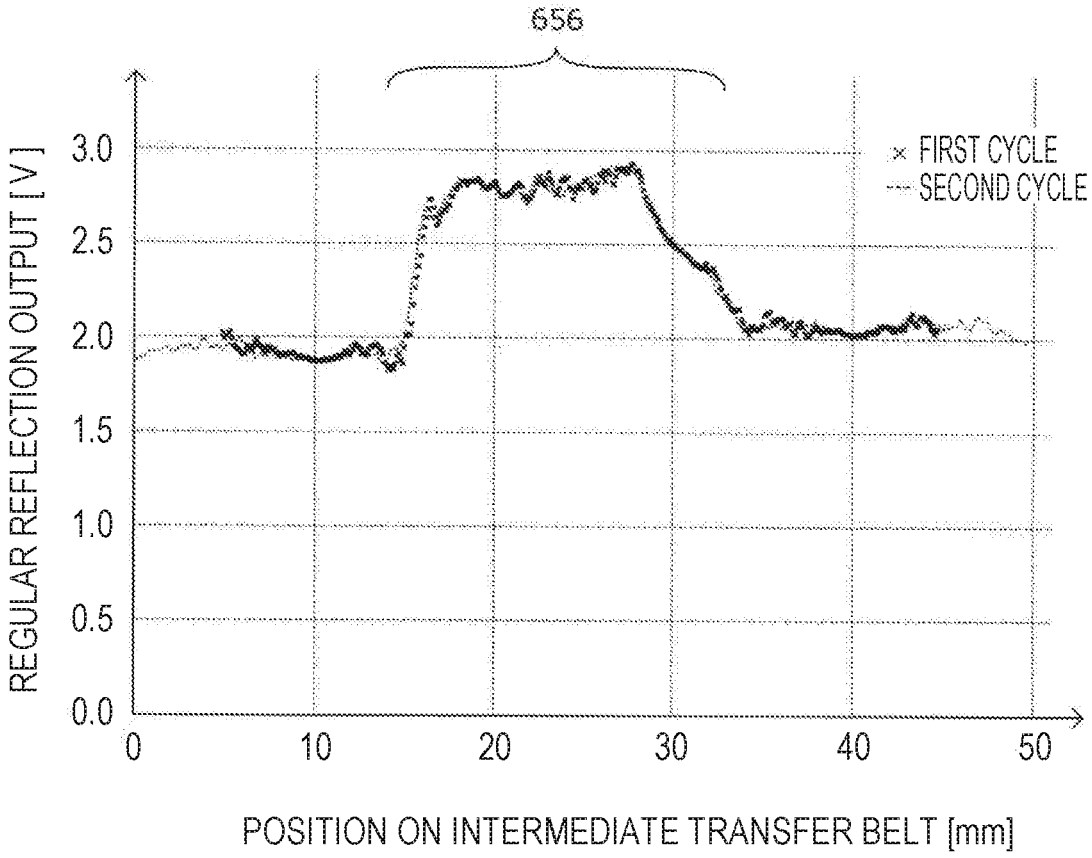
FIG. 17 is a graph for showing waveform data acquired in circumferential length measurement in the third embodiment.

FIG. 17 shows an example of the waveform data on the first cycle and the waveform data on the second cycle each including the non-processed portion 656 in a case of using the intermediate transfer belt 205 in the third embodiment, which is similar to FIG. 10A in the first embodiment. On the horizontal axis, the measurement start point is set to 0 for the waveform data on the second cycle, and the data earlier than the measurement start point for the second cycle by the nominal circumferential length is set to 0 for the waveform data on the first cycle. The regular reflection output is reduced by the imprint processing as described in the first embodiment, and hence the regular reflection output of the processed portion 657 is smaller than the regular reflection output of the non-processed portion 656. In the third embodiment, the non-processed portion 656 is present in a part of the intermediate transfer belt 205 in its circumferential direction, and hence the regular reflection output increases only when the non-processed portion 656 is being measured. In the non-processed portion 656, the regular reflection output exhibits a change steep, and hence the circumferential length measurement can be performed with high accuracy in the same manner as in the case of the first embodiment.

In view of this, in the third embodiment, the non-processed portion 656 on the intermediate transfer belt 205 is used to acquire the information relating to the circumferential length of the intermediate transfer belt 205 by the same method as that of the first embodiment. In addition, the timing to acquire the output (background output and patch output) of the optical sensor 218 in the image density control is controlled based on the result of the circumferential length measurement. For the specific method, the description of the first embodiment is incorporated herein by reference by replacing the overlapping portion 228 with the non-processed portion 656.

As described above, in the third embodiment, the circumferential length measurement for the intermediate transfer belt 205 is performed at the non-processed portion 656 at which the output of the optical sensor 218 locally changes. Thus, it is possible to perform the circumferential length measurement for the intermediate transfer belt 205 with high accuracy, and as a result, it is possible to perform the image density control with high accuracy. In addition, in the third embodiment, an image can be formed without distinguishing the non-processed portion 656 and the processed portion 657, and hence it is possible to suppress the reduction in throughput at the time of printing. Further, even in the third embodiment, the same other effects as those of the first embodiment can be obtained.

Fourth Embodiment

Next, another embodiment of the present disclosure is described. A basic configuration and a basic operation of an image forming apparatus according to a fourth embodiment are the same as those of the image forming apparatus according to the first embodiment. Thus, in the image forming apparatus according to the fourth embodiment, components having the same or corresponding functions or configurations as those of the image forming apparatus according to the first embodiment are denoted by the same reference symbols as those in the first embodiment, and detailed description thereof is omitted.

In the fourth embodiment, the intermediate transfer belt 205 includes the non-processed portion 656 as the area having an optical peculiarity in the same manner as in the third embodiment. In the fourth embodiment, with such a configuration, the area having an optical peculiarity is used to detect the reference position in the circumferential direction of the intermediate transfer belt 205 in the same manner as in the second embodiment. For the intermediate transfer belt 205, the description of the third embodiment is incorporated herein by reference. For the method of adjusting the measurement timing of the background output and the measurement timing of the patch output through use of the non-processed portion 656, the description of the second embodiment is incorporated herein by reference by replacing the overlapping portion 228 with the non-processed portion 656.

Figure 18:
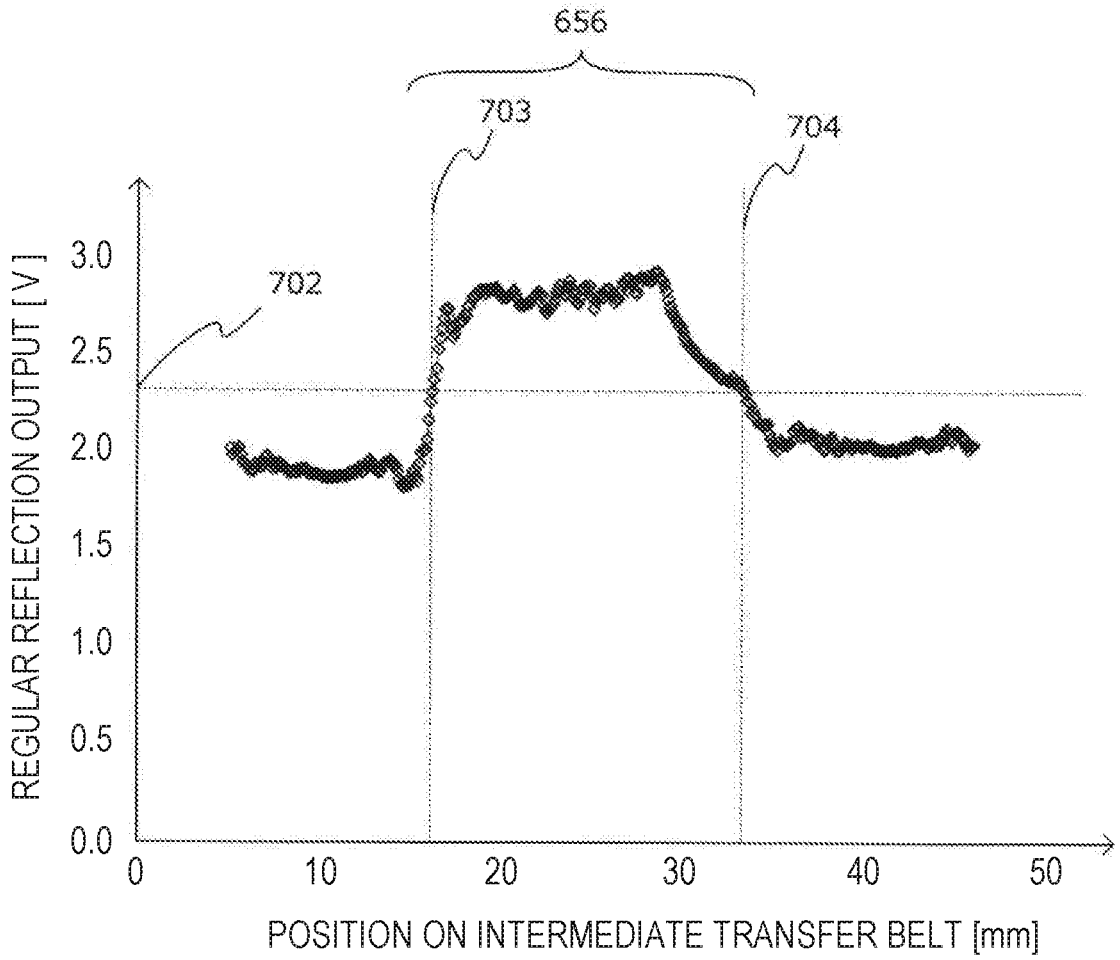
FIG. 18 is a graph for showing a method of detecting a reference position on the intermediate transfer belt in a fourth embodiment.

FIG. 18 is a graph for showing an example of the regular reflection output of the optical sensor 218 in the vicinity of the non-processed portion 656. As described in the third embodiment, the regular reflection output is locally increased at the non-processed portion 656. In the fourth embodiment, a non-processed portion determination value 702 is set as the reference value. Then, in the fourth embodiment, a timing at which the regular reflection output exceeds the non-processed portion determination value 702 in accordance with the rotation of the intermediate transfer belt 205 is determined to be a non-processed portion leading edge timing 703. The non-processed portion leading edge timing 703 corresponds to a timing at which a leading edge position of the non-processed portion 656 in the conveying direction of the intermediate transfer belt 205 passes through the detection position of the optical sensor 218. In addition, in the fourth embodiment, a timing at which the regular reflection output falls below the non-processed portion determination value 702 in accordance with the further rotation of the intermediate transfer belt 205 is determined to be a non-processed portion trailing edge timing 704. The non-processed portion trailing edge timing 704 corresponds to a timing at which a trailing edge position of the non-processed portion 656 in the conveying direction of the intermediate transfer belt 205 passes through the detection position of the optical sensor 218. In the fourth embodiment, a fixed value of 2.3 V is set as the non-processed portion determination value 702. However, the non-processed portion determination value 702 is not limited thereto. As described in the second embodiment, the regular reflection output may fluctuate due to the abrasion of the surface layer of the intermediate transfer belt 205. Thus, in the same manner as in the case of the overlapping portion determination value 602 in the second embodiment, for example, it is also possible to dynamically set the non-processed portion determination value 702 by calculating the non-processed portion determination value 702 based on the average value of the regular reflection output within the predetermined range (corresponding to, typically, about one cycle of the intermediate transfer belt 205) with respect to the circumferential direction of the intermediate transfer belt 205. Further, the non-processed portion determination value 702 may be changed based on the index value (for example, number of revolutions or rotation time period) correlating with the usage amount of the intermediate transfer belt 205.

As described above, in the fourth embodiment, the non-processed portion 656 on the intermediate transfer belt 205 is used as the reference position to set the measurement timing of the background output and the measurement timing of the patch output. Thus, the measurement position of the background output and the measurement position of the patch output with respect to the circumferential direction of the intermediate transfer belt 205 can be set as the same position with high accuracy. Thus, according to the fourth embodiment, the same effects as those of the first and third embodiments can be produced, and the control can be simplified as compared with the first and third embodiments.

[Others]

The present disclosure is described above by way of specific embodiments. However, the present disclosure is not limited to the embodiments described above.

The description of each of the above-mentioned embodiments is directed to the case in which the rotary member is an intermediate transfer member, but the rotary member may be not only a member configured to directly bear and convey a toner image, such as an intermediate transfer member, but also a recording material bearing member configured to bear and convey a toner image via a recording material. That is, hitherto, there is an image forming apparatus including, in place of the intermediate transfer member in each of the above-mentioned embodiments, a recording material bearing member configured to bear and convey a recording material onto which a toner image is to be transferred from an image bearing member, for example, a photosensitive member. The recording material bearing member is formed of, for example, an endless belt in the same manner as the intermediate transfer member in each of the above-mentioned embodiments. Even in regard to the recording material bearing member, for example, the test toner image may be formed on its surface to perform the image density control, and it may be desired to acquire, for example, the information relating to the circumferential length as the information relating to the position in the circumferential direction. Thus, even when the rotary member is a recording material bearing member, the same effects as those of each of the above-mentioned embodiments can be produced by applying the present disclosure. The rotary member configured to directly bear and convey a toner image may be a photosensitive member or an electrostatic recording dielectric member. In addition, the rotary member is not limited to one formed of an endless belt, and may be, for example, a drum-shaped rotary member.

Further, in each of the above-mentioned embodiments, the plurality of grooves on the surface of the rotary member are formed along the width direction of the rotary member so as to extend substantially parallel with the circumferential direction of the rotary member, but are not limited thereto. It suffices that the grooves extend along the circumferential direction of the rotary member, and the grooves may be formed at an angle with respect to the circumferential direction of the rotary member. However, from the viewpoint of lowering the friction force with respect to the cleaning member or another such viewpoint, the angle formed by an extending direction of the grooves with respect to the circumferential direction of the rotary member is preferred to be 45 degrees or less, and further preferred to be 10 degrees or less.

Further, in each of the above-mentioned embodiments, the grooves on the surface of the rotary member are formed at substantially regular intervals in the width direction of the rotary member. However, the grooves are not limited to the grooves thus formed regularly (periodically), and may be formed irregularly with respect to the width direction of the rotary member. Further, typically, the grooves on the surface of the rotary member are continuously formed along the circumferential direction of the rotary member, but may be formed by being divided into a plurality of pieces. Even in this case, it is possible to provide the area having an optical peculiarity by changing the number of times of imprint processing.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-185564, filed Oct. 8, 2019, which is hereby incorporated by reference herein in its entirety.

What is claimed is:

1. An image forming apparatus, comprising:

a rotary member, which is endless and movable, and is configured to bear a toner image directly on a surface of the rotary member or via a recording material;

a detecting member configured to detect light from the surface of the rotary member; and a controller configured to acquire information relating to a position on the rotary member in a moving direction of the rotary member based on a detection result obtained by the detecting member, wherein the rotary member has a plurality of grooves along the moving direction on the surface of the rotary member with respect to a width direction of the rotary member perpendicular to the moving direction, and has, with respect to the moving direction, a first area and a second area having a shorter length in the moving direction than the first area, the first area and the second area being different from each other in friction coefficient with respect to the width direction, and wherein the controller acquires the information relating to the position on the rotary member in the moving direction based on a result of detecting, by the detecting member, light from the surface of the rotary member including at least the second area with respect to the moving direction.

2. The image forming apparatus according to claim 1, wherein an interval between adjacent ones of the plurality of grooves in the second area is narrower than an interval between adjacent ones of the plurality of grooves in the first area.

3. The image forming apparatus according to claim 1, wherein the detecting member detects light from the surface of the rotary member in an area on the rotary member for bearing the toner image with respect to the width direction.

4. The image forming apparatus according to claim 1, wherein the controller acquires the information relating to the position on the rotary member in the moving direction by causing the detecting member to detect the second area twice along with rotation of the rotary member.

5. The image forming apparatus according to claim 4, wherein the controller acquires first data through detection in a first time by the detecting member in an area including the second area with respect to the moving direction, and acquires second data through detection in a second time by the detecting member in an area including the second area with respect to the moving direction at a timing different from a timing at which the first data is acquired, and wherein the controller acquires information relating to a circumferential length of the rotary member as the information relating to the position on the rotary member in the moving direction based on collating the first data and the second data with each other.

6. The image forming apparatus according to claim 1, wherein the controller acquires information relating to a density of a test toner image based on a first detection result of detecting, by the detecting member, light from the surface of the rotary member on which the test toner image is to be formed and a second detection result of detecting, by the detecting member, light from the test toner image formed on the surface of the rotary member, and wherein the controller adjusts a timing to acquire the second detection result with respect to a timing to acquire the first detection result so that a position for acquiring the first detection result and a position for acquiring the second detection result match each other with respect to the moving direction based on the acquired information relating to the position on the rotary member in the moving direction.

7. The image forming apparatus according to claim 6, wherein the controller determines (i) positions for acquiring the first detection result and the second detection result with respect to the moving direction or (ii) timings corresponding to the positions, based on the acquired information relating to the position on the rotary member in the moving direction.

8. The image forming apparatus according to claim 7, wherein the controller determines (i) the positions for acquiring the first detection result and the second detection result with respect to the moving direction or (ii) the timings corresponding to the positions, so as to form the test toner image while avoiding the second area with respect to the moving direction.

9. The image forming apparatus according to claim 1, wherein the controller acquires information relating to (i) a reference position of the rotary member with respect to the moving direction or (ii) a timing corresponding to the reference position based on a timing at which reflection light reflected from the second area is detected by the detecting member.

10. The image forming apparatus according to claim 1, wherein an amount of reflection light from the surface of the rotary member obtained by detection of the detecting member in the first area is different from an amount of reflection light from the surface of the rotary member obtained by detection of the detecting member in the second area.

11. The image forming apparatus according to claim 10, wherein the second area is different from an area adjacent to the second area with respect to the moving direction in at least one of an average value of intervals between the plurality of grooves in the width direction and an average value of depths of the plurality of grooves.

12. The image forming apparatus according to claim 1, wherein the plurality of grooves are continuously formed in the moving direction, and the second area is an area in which both end portions of each of the plurality of grooves with respect to the moving direction overlap each other.

13. The image forming apparatus according to claim 1, wherein the rotary member has only the first area and the second area with respect to the moving direction, the first area being an area in which the plurality of grooves are continuously formed in the moving direction, the second area being an area formed by preventing both end portions of each of the plurality of grooves with respect to the moving direction in the first area from overlapping each other, in which area the plurality of grooves are not formed.

14. The image forming apparatus according to claim 1, further comprising an image bearing member configured to bear a toner image, wherein the rotary member comprises an intermediate transfer member configured to convey the toner image primarily transferred from the image bearing member, in order to secondarily transfer the toner image onto the recording material.

15. The image forming apparatus according to claim 1, wherein the rotary member comprises an endless belt.

* * * * *